US012669280B2

(12) United States Patent
Allard et al.

(10) Patent No.: US 12,669,280 B2
(45) Date of Patent: Jun. 30, 2026

(54) REFRIGERATOR WITH A VACUUM-INSULATED STRUCTURE SUPPORTED BY A STRUCTURAL SUPPORT WITH A BASEPLATE WELDED TO THE VACUUM-INSULATED STRUCTURE

(71) Applicant: WHIRLPOOL CORPORATION, Benton Harbor, MI (US)

(72) Inventors: Paul Bennett Allard, Coloma, MI (US); Vishal Brahmanand Chauhan, Palghar (IN); Narendra Ashok Kapure, Pune (IN); Rahul Sadanand Kumbhare, Gadchiroli (IN); Abinash Sarma, Tinsukia (IN)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 288 days.

(21) Appl. No.: 18/524,873

(22) Filed: Nov. 30, 2023

(65) Prior Publication Data

US 2025/0180278 A1 Jun. 5, 2025

(51) Int. Cl.
*F25D 23/00* (2006.01)
*F25D 23/06* (2006.01)

(52) U.S. Cl.
CPC ..... *F25D 23/006* (2013.01); *F25D 23/003* (2013.01); *F25D 23/062* (2013.01); *F25D 23/00* (2013.01); *F25D 23/063* (2013.01); *F25D 2201/14* (2013.01)

(58) Field of Classification Search
CPC ..... F25D 11/02; F25D 23/006; F25D 23/003; F25D 23/062; F25D 23/00; F25D 23/063; F25D 23/06; F25D 2201/14
USPC ..... 62/440
See application file for complete search history.

(56) References Cited

U.S. PATENT DOCUMENTS 4,580,852 A * 4/1986 Smitte ..... F25D 23/062 312/406.2
11,828,525 B2 * 11/2023 Harikrishnasamy ..... F25D 23/066
11,927,386 B2 * 3/2024 Jung ..... F25D 23/062
2008/0011006 A1 * 1/2008 Luisi ..... F25D 23/10 312/406
2012/0118002 A1 * 5/2012 Kim ..... F16L 59/065 428/69
2017/0176092 A1 6/2017 Naik
2018/0187961 A1 * 7/2018 Lim ..... F25D 27/00
(Continued)

FOREIGN PATENT DOCUMENTS

CN 108626943 A * 10/2018 ..... F25D 17/04
DE 102011006255 A1 * 10/2012 ..... F25D 23/10
(Continued)

*Primary Examiner* — Jenna M Maroney
*Assistant Examiner* — Gustavo A Hincapie Serna
(74) *Attorney, Agent, or Firm* — Price Heneveld LLP

(57) ABSTRACT

A refrigerator including: (a) a vacuum-insulated structure including (i) an inner liner defining a refrigeration compartment or a freezer compartment, (ii) an outer wrapper at least partially enveloping the inner liner, the outer wrapper including a bottom wall disposed beneath the inner liner, the bottom wall presenting a bottom surface that faces downward; (b) a baseplate that is horizontally oriented and welded to the bottom surface of the bottom wall; (c) side panels coupled to the baseplate, extending downward from the baseplate, and structurally supporting the vacuum-insulated structure; and (d) a cross-member attached to the side panels.

9 Claims, 30 Drawing Sheets

(56) References Cited

U.S. PATENT DOCUMENTS

| | | | | |
|---|---|---|---|---|
| 2018/0266620 | A1* | 9/2018 | Kawarazaki | F25D 23/06 |
| 2018/0266750 | A1* | 9/2018 | Hurlebaus | F25D 23/087 |
| 2019/0003757 | A1* | 1/2019 | Miros | G06Q 10/08 |
| 2019/0101320 | A1 | 4/2019 | Dherde et al. | |
| 2019/0128593 | A1* | 5/2019 | Deka | F16L 59/065 |
| 2019/0360737 | A1* | 11/2019 | Lv | F25C 5/22 |
| 2021/0140702 | A1* | 5/2021 | Park | F25D 23/006 |
| 2021/0140703 | A1* | 5/2021 | Wong | F25D 23/062 |
| 2021/0199368 | A1* | 7/2021 | Awachat | F25D 23/085 |
| 2022/0003485 | A1 | 1/2022 | Gochika et al. | |
| 2022/0011041 | A1 | 1/2022 | Harikrishnasamy et al. | |
| 2022/0316790 | A1* | 10/2022 | Hunter | F25D 23/067 |
| 2022/0400858 | A1* | 12/2022 | Harikrishnasamy | A47B 77/08 |
| 2022/0412639 | A1 | 12/2022 | Hunter et al. | |
| 2023/0010720 | A1 | 1/2023 | Beckner et al. | |
| 2023/0080310 | A1* | 3/2023 | Kang | F25D 23/064 312/401 |
| 2023/0288135 | A1* | 9/2023 | Park | F25D 23/028 |
| 2024/0068735 | A1* | 2/2024 | Kim | F25D 23/028 |
| 2024/0183607 | A1* | 6/2024 | Zhao | F25D 23/02 |
| 2024/0247863 | A1* | 7/2024 | Passley | F25D 23/063 |
| 2025/0164180 | A1* | 5/2025 | Song | F25D 27/00 |

FOREIGN PATENT DOCUMENTS

| | | | |
|---|---|---|---|
| EP | 0769667 | A2 | 4/1997 |
| EP | 3500804 | B1 | 6/2022 |
| EP | 4023973 | A1 | 7/2022 |
| EP | 4067790 | A1 | 10/2022 |
| RU | 2370714 | C2 | 10/2009 |

* cited by examiner

REFRIGERATOR WITH A VACUUM-INSULATED STRUCTURE SUPPORTED BY A STRUCTURAL SUPPORT WITH A BASEPLATE WELDED TO THE VACUUM-INSULATED STRUCTURE

BACKGROUND OF THE DISCLOSURE

The present disclosure generally relates to a refrigerator, and more specifically, to a refrigerator with a vacuum-insulated structure and a structural support that is welded to the vacuum-insulated structure to support the weight thereof.

A refrigerator can be of the built-in variety, where the refrigerator is intended to be recessed into cabinetry, rather than the stand-alone variety. Further, the refrigerator can have an equipment room to house the mechanical components of a refrigeration system (e.g., compressor and condenser) below the refrigeration compartment(s) (e.g., a "bottom mounted" equipment room below a freezer compartment and/or refrigerator compartment). In such instances, the refrigerator includes a support structure that both houses the equipment room and supports the refrigerator compartment above the equipment room. Still further, the refrigerator can include a vacuum-insulated structure that defines the refrigeration compartment(s) above the equipment room. The vacuum-insulated structure typically includes an outer wrapper at least partially enveloping one or more inner liners that define the refrigeration compartment(s) with a space between the outer wrapper and the inner liner(s) that is maintained at a pressure below atmospheric pressure (e.g., a "vacuum" or "negative" pressure).

However, there is a problem in that the vacuum-insulated structure typically cannot be fastened to the support structure with fasteners that extend through an outer wrapper of the vacuum-insulated structure, because doing so would break the negative pressure within the vacuum insulated structure.

SUMMARY OF THE DISCLOSURE

According to one aspect of the present disclosure, a refrigerator comprises: (a) a vacuum-insulated structure comprising (i) an inner liner defining a refrigeration compartment or a freezer compartment, and (ii) an outer wrapper at least partially enveloping the inner liner, the outer wrapper comprising a bottom wall disposed beneath the inner liner, the bottom wall presenting a bottom surface that faces downward; (b) a baseplate that is horizontally oriented and welded to the bottom surface of the bottom wall; (c) side panels coupled to the baseplate, extending downward from the baseplate, and structurally supporting the vacuum-insulated structure; and (d) a cross-member attached to the side panels.

According to another aspect of the present disclosure, a refrigerator comprises: (a) a vacuum-insulated structure comprising (i) an inner liner defining a refrigeration compartment or a freezer compartment and (ii) an outer wrapper at least partially enveloping the inner liner, the outer wrapper comprising a bottom wall disposed below the inner liner, the bottom wall presenting a bottom surface that faces downward; (b) a baseplate that is horizontally oriented and welded to the bottom surface of the bottom wall; (c) a pair of side panels that oppose each other extending downward from side edges of the baseplate, each of pair of side panels comprising (i) a lateral wall with an inward surface, (ii) a top lip extending inward from the lateral wall, and (iii) a bottom lip extending inward from the lateral wall elevationally below the top lip; and (d) at each of the pair of side panels, leg supports welded to (i) the top lip of the side panel, (ii) the inward surface of the lateral wall of the side panel, and (iii) the bottom lip of the side panel; wherein, the leg supports at least partially bear a weight of the vacuum-insulated structure.

According to yet another aspect of the present disclosure, a refrigerator comprises: (a) a vacuum-insulated structure comprising (i) an inner liner defining a refrigeration compartment or a freezer compartment, (ii) an outer wrapper at least partially enveloping the inner liner, the outer wrapper comprising a bottom wall disposed beneath the inner liner, the bottom wall presenting a bottom surface that faces downward; (b) a baseplate that is horizontally oriented and welded to the bottom surface of the bottom wall of the outer wrapper, the baseplate comprising (i) lips that extend downward relative to a top surface of the baseplate, one of the lips disposed at each of two lateral sides of the baseplate, (ii) clinch studs disposed laterally inward of the lips and proximate the lips, the clinch studs extending downward from a bottom surface of the baseplate, and (iii) tabs disposed laterally inward of and facing the lips, the tabs extending downward from the bottom surface of the baseplate; (c) a pair of side panels that oppose each other extending downward from the baseplate, each of pair of side panels comprising (i) a top wall disposed under the baseplate at a side of the baseplate, (ii) an outer side wall extending downward from the top wall and facing the lip of the baseplate also disposed at the side of the baseplate, and (iii) an inner side wall extending downward from the top wall inward of the outer side wall and facing the tabs of the baseplate also disposed at the side of the baseplate, such that the side panel is sandwiched between the lip of the baseplate disposed at the side of the baseplate and the tabs of the baseplate, and (d) fasteners extending through apertures that are aligned through the lip of the baseplate, the outer side walls of the pair of side panels, the inner side walls of the pair of side panels, and the tabs of the baseplate to fasten the pair of side panels to the baseplate, wherein, the pair of side panels at least partially bear a weight of the vacuum-insulated structure.

These and other features, advantages, and objects of the present disclosure will be further understood and appreciated by those skilled in the art by reference to the following specification, claims, and appended drawings.

Figure 1:
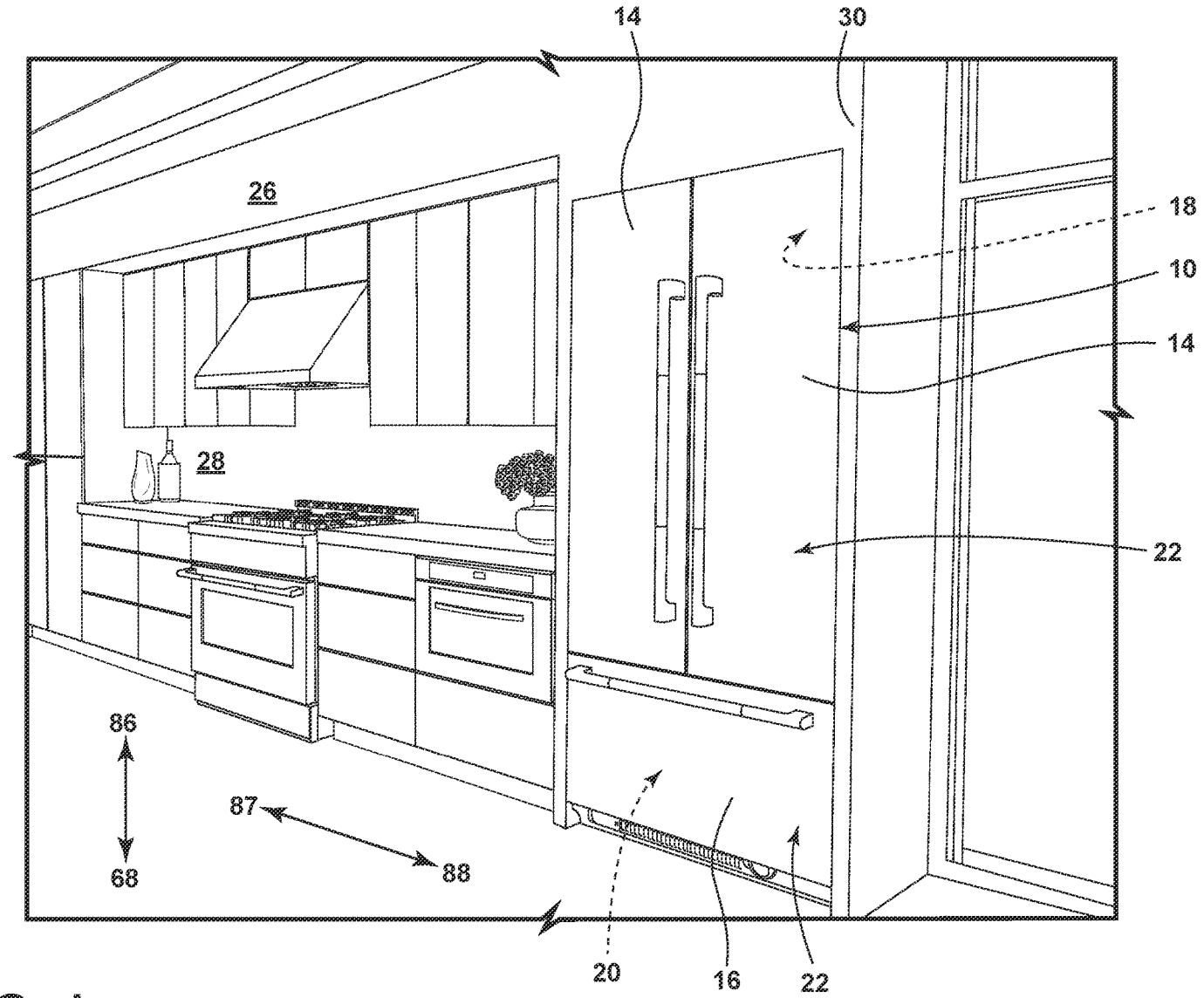
FIG. 1 is a perspective view of a refrigerator of the present disclosure in a kitchen with doors and a drawer in a closed position separating a refrigeration compartment and a freezer compartment, respectively, from an external environment.

The components in the figures are not necessarily to scale, emphasis instead being placed upon illustrating the principles described herein.

DETAILED DESCRIPTION

The present illustrated embodiments reside primarily in combinations of method steps and apparatus components related to a refrigerator. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Figure 2:
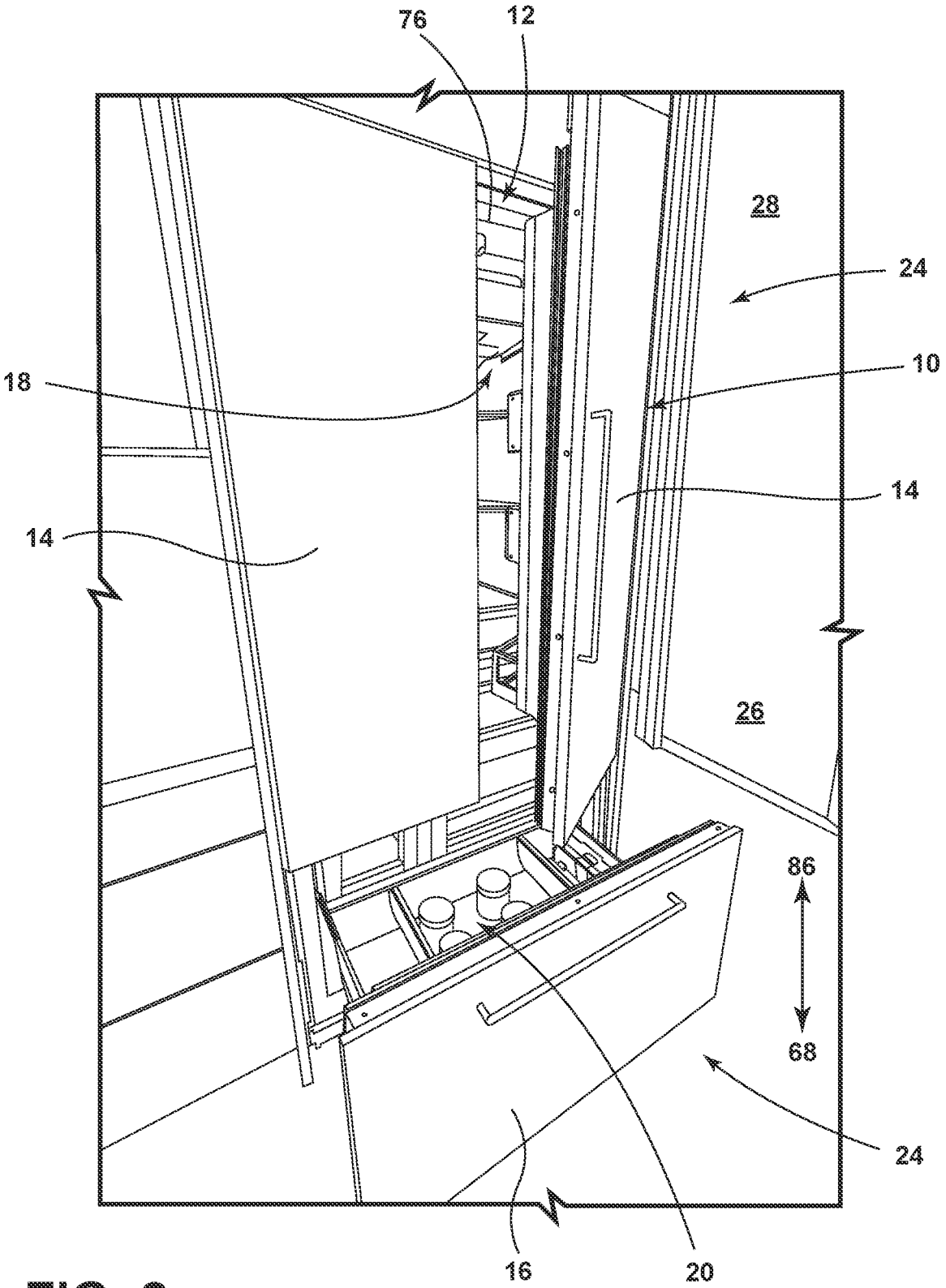
FIG. 2 is another perspective view of the refrigerator of FIG. 1 but this time with one of the doors and the drawer in an open position permitting access from the external environment into the refrigeration compartment and the freezer compartment, respectively.
Figure 3:
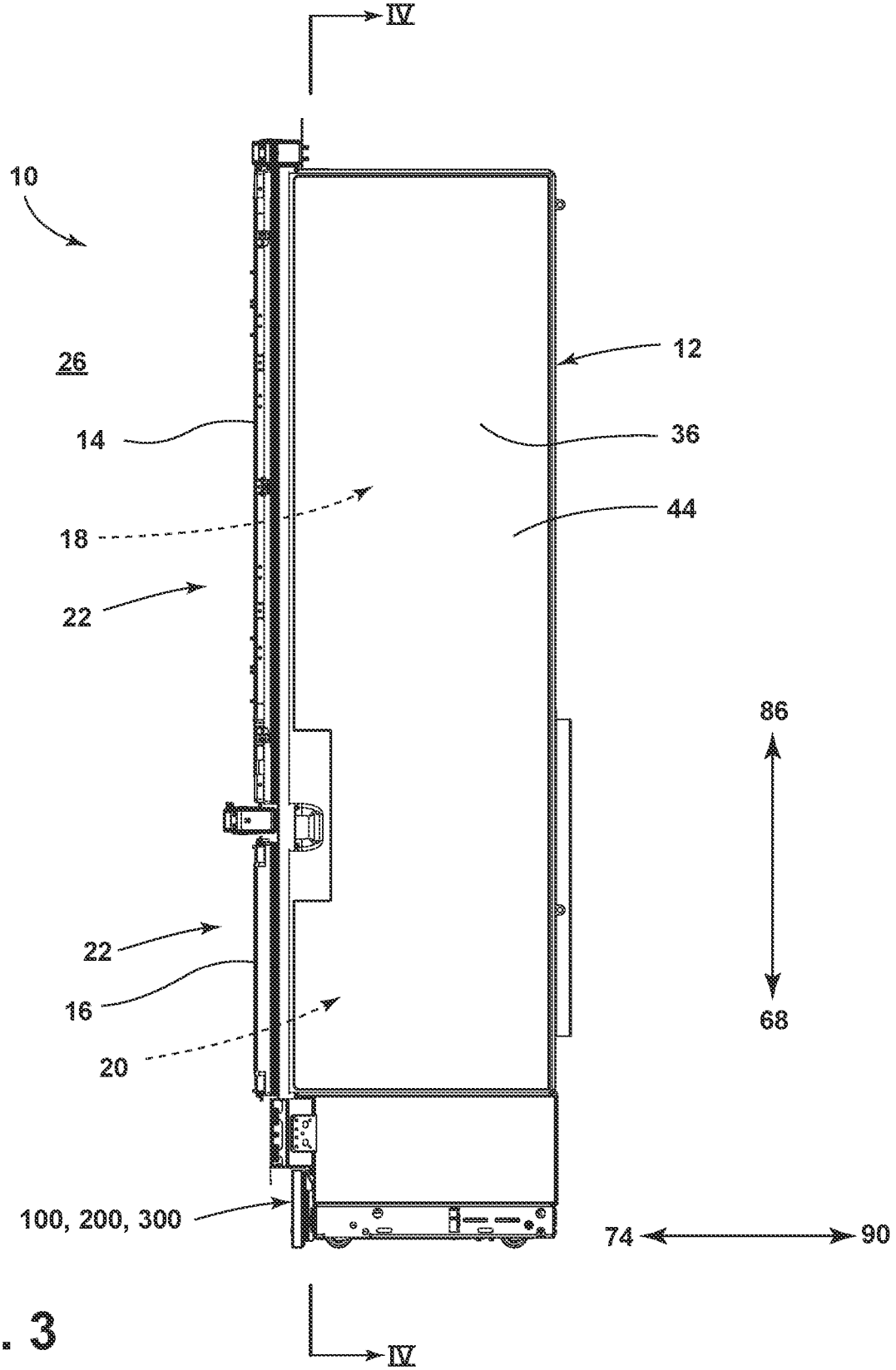
FIG. 3 is a side elevational view of the refrigerator of FIG. 1, illustrating the refrigerator including a cabinet supported by a support structure.
Figure 4:
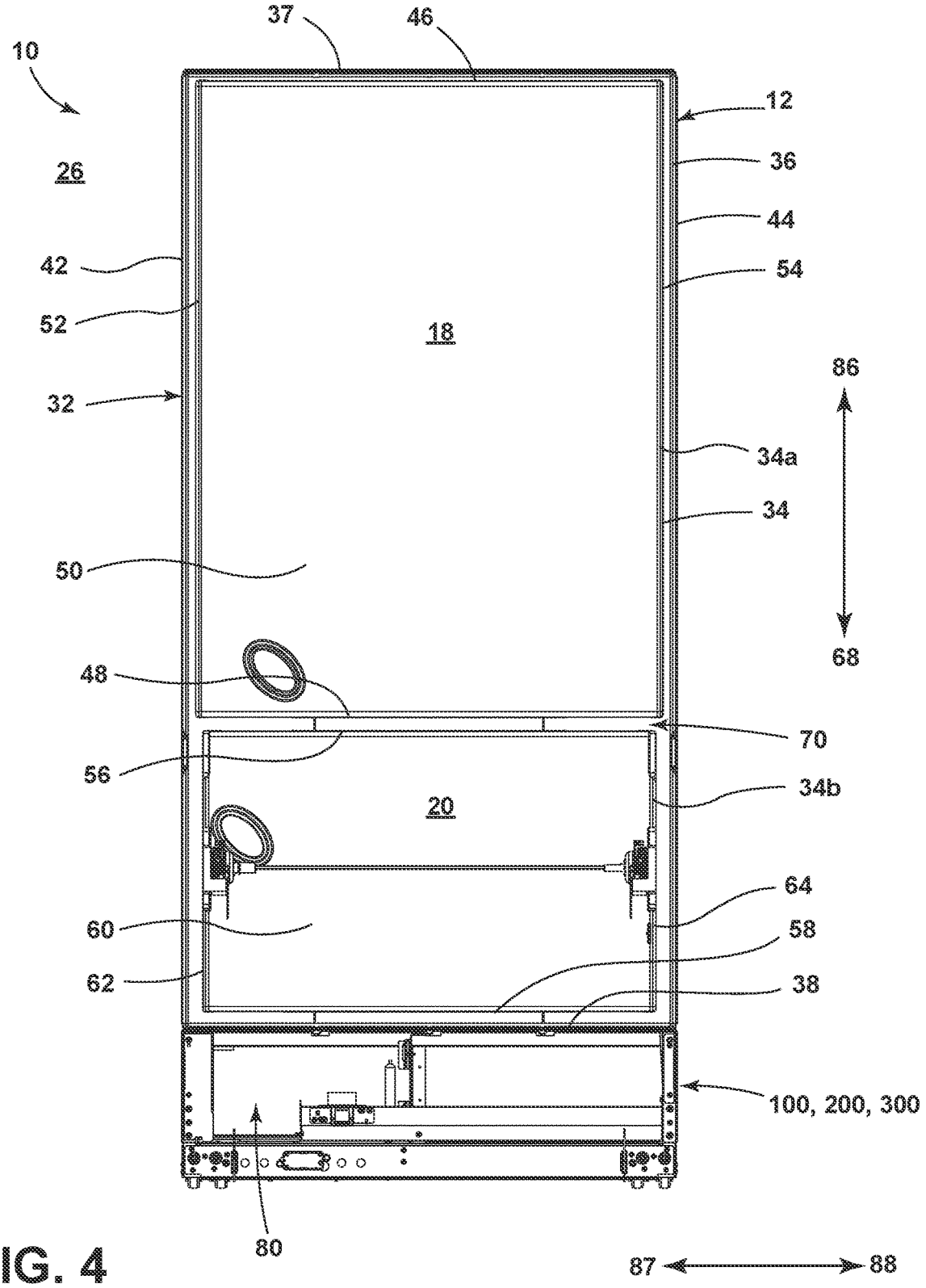
FIG. 4 is a front elevational view of a cross-section of the refrigerator of FIG. 1 taken through line IV-IV of FIG. 3, illustrating the cabinet including a vacuum-insulated structure with an outer wrapper at least partially enveloping a first inner liner and a second inner liner.
Figure 5:
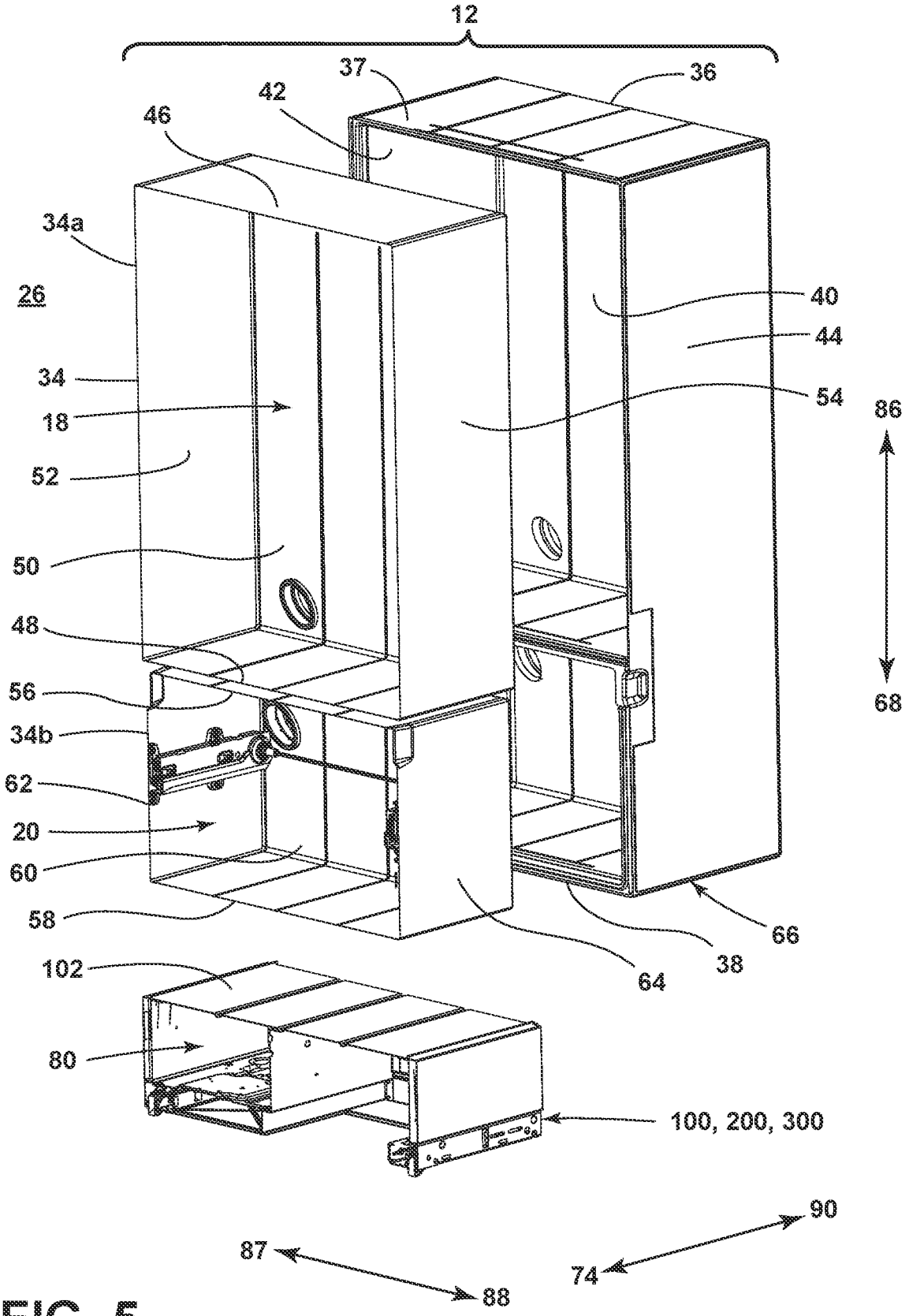
FIG. 5 is front perspective exploded view of the cross-section of the refrigerator of FIG. 1 taken through line IV-IV of FIG. 3, illustrating the outer wrapper having a bottom wall and the structural support having a baseplate facing and supporting the bottom wall of the outer wrapper.
Figure 6:
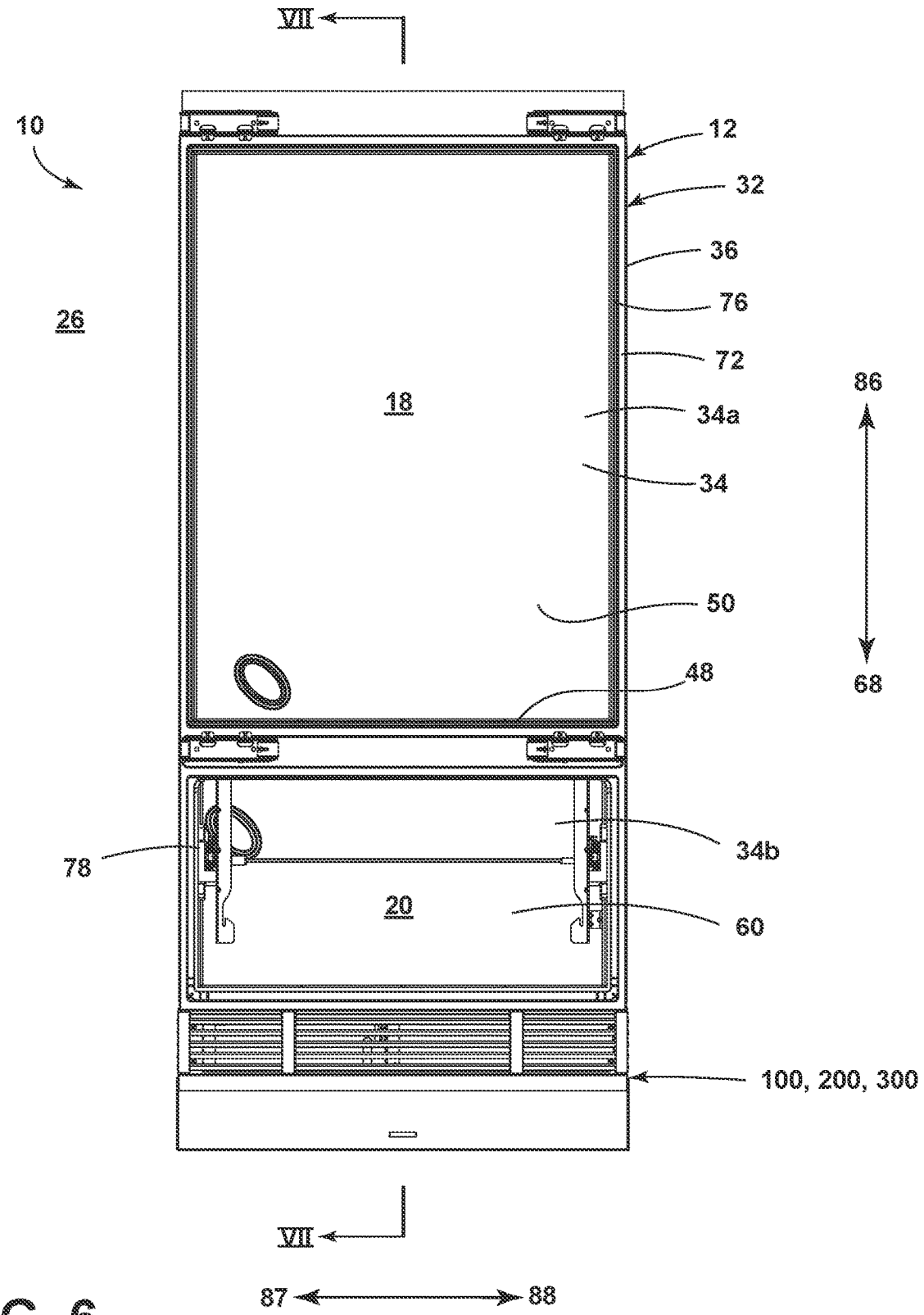
FIG. 6 is a front elevational view of the refrigerator of FIG. 1 without the doors and the drawer illustrating the first inner liner defining the refrigeration compartment and the second inner liner defining the freezer compartment.
Figure 7:
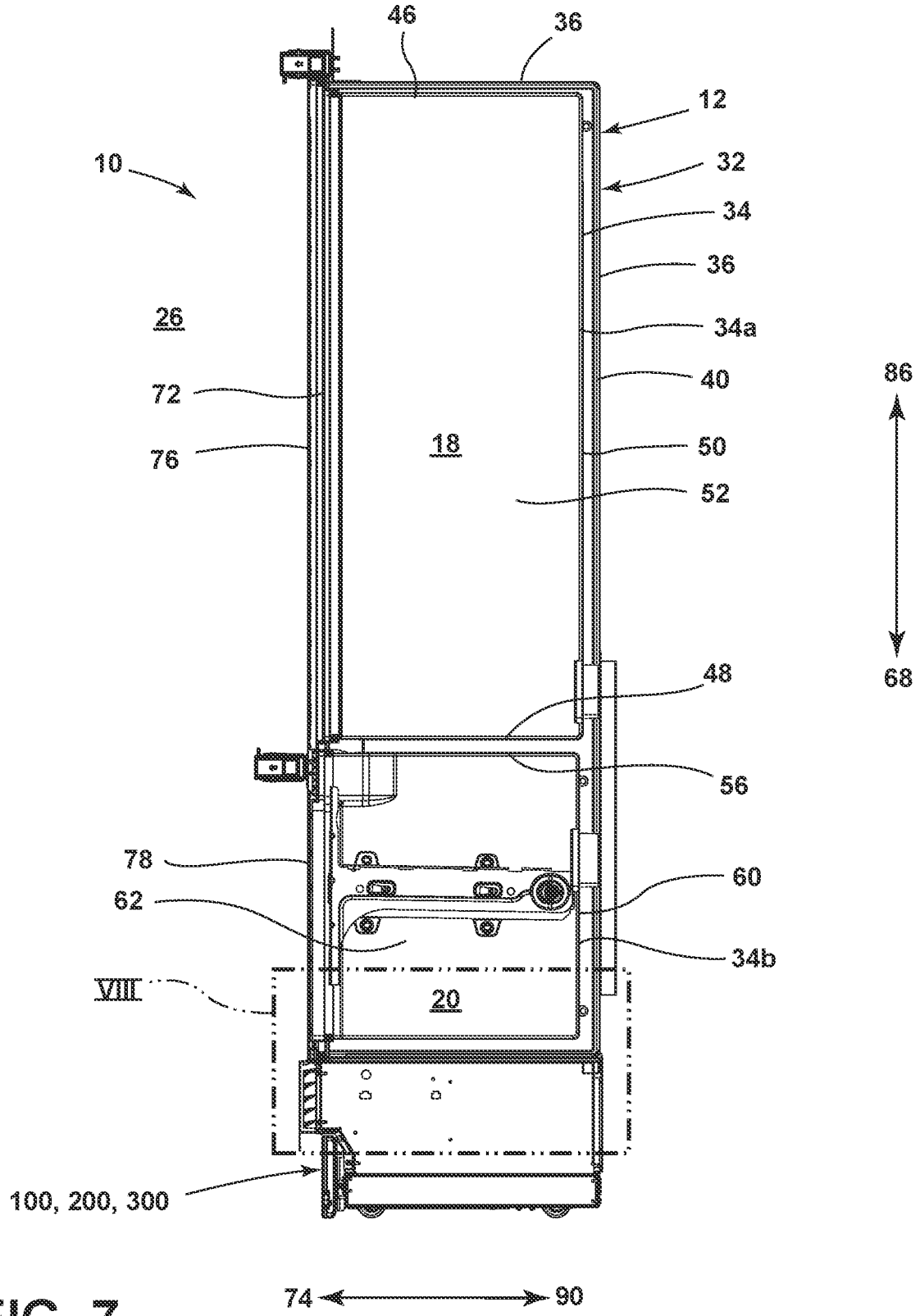
FIG. 7 is a side elevational view of a cross-section of the refrigerator of FIG. 1 taken through line VII-VII of FIG. 6, illustrating a trim breaker coupled to all of the first inner liner, the second inner liner, and the outer wrapper to maintain a space between the first inner liner, the second inner liner, and the outer wrapper at a pressure that is less than atmospheric pressure.
Figure 8:
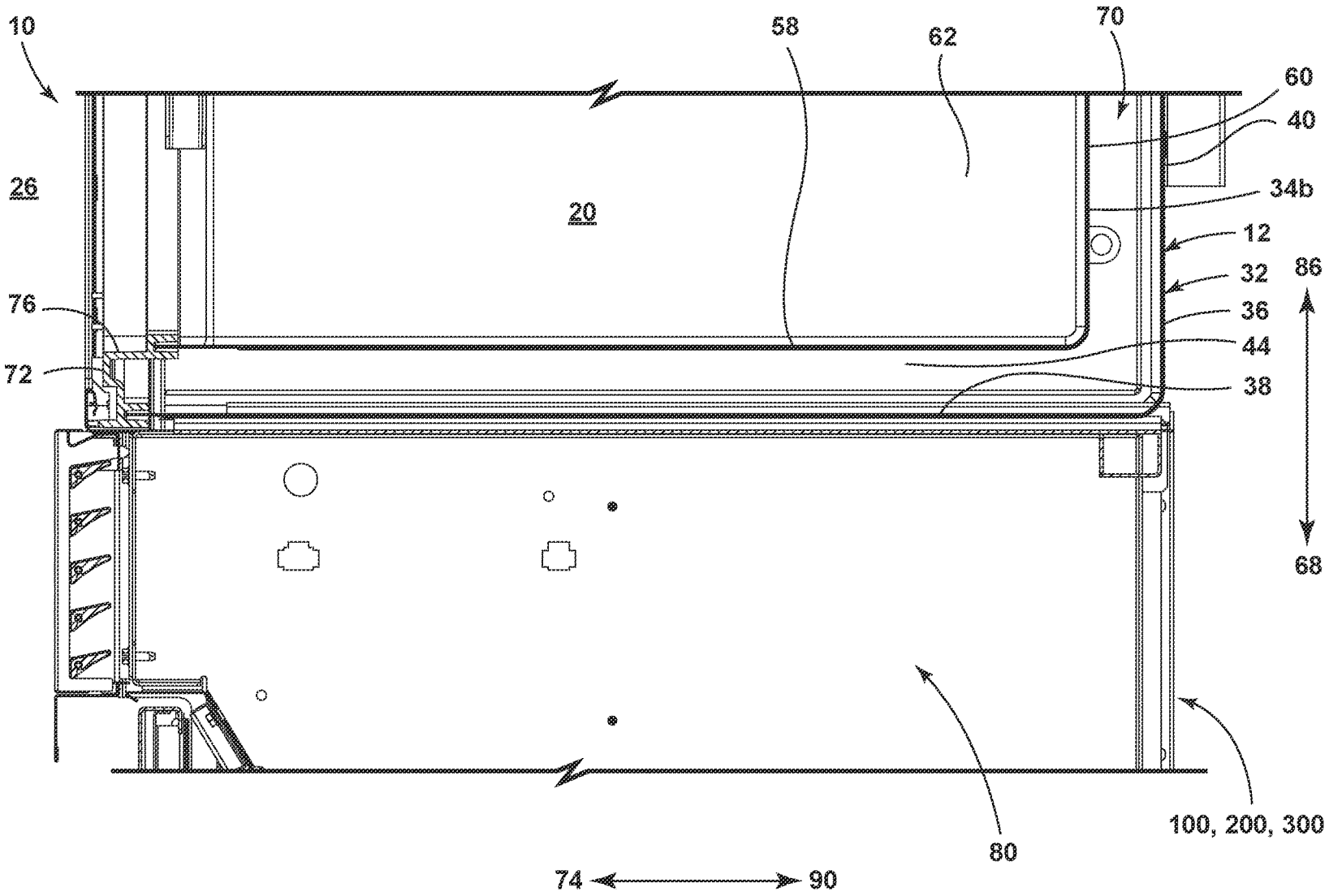
FIG. 8 is a magnified view of area VIII of FIG. 7, illustrating the structural support defining a machine room below the vacuum-insulated structure.
Figure 9:
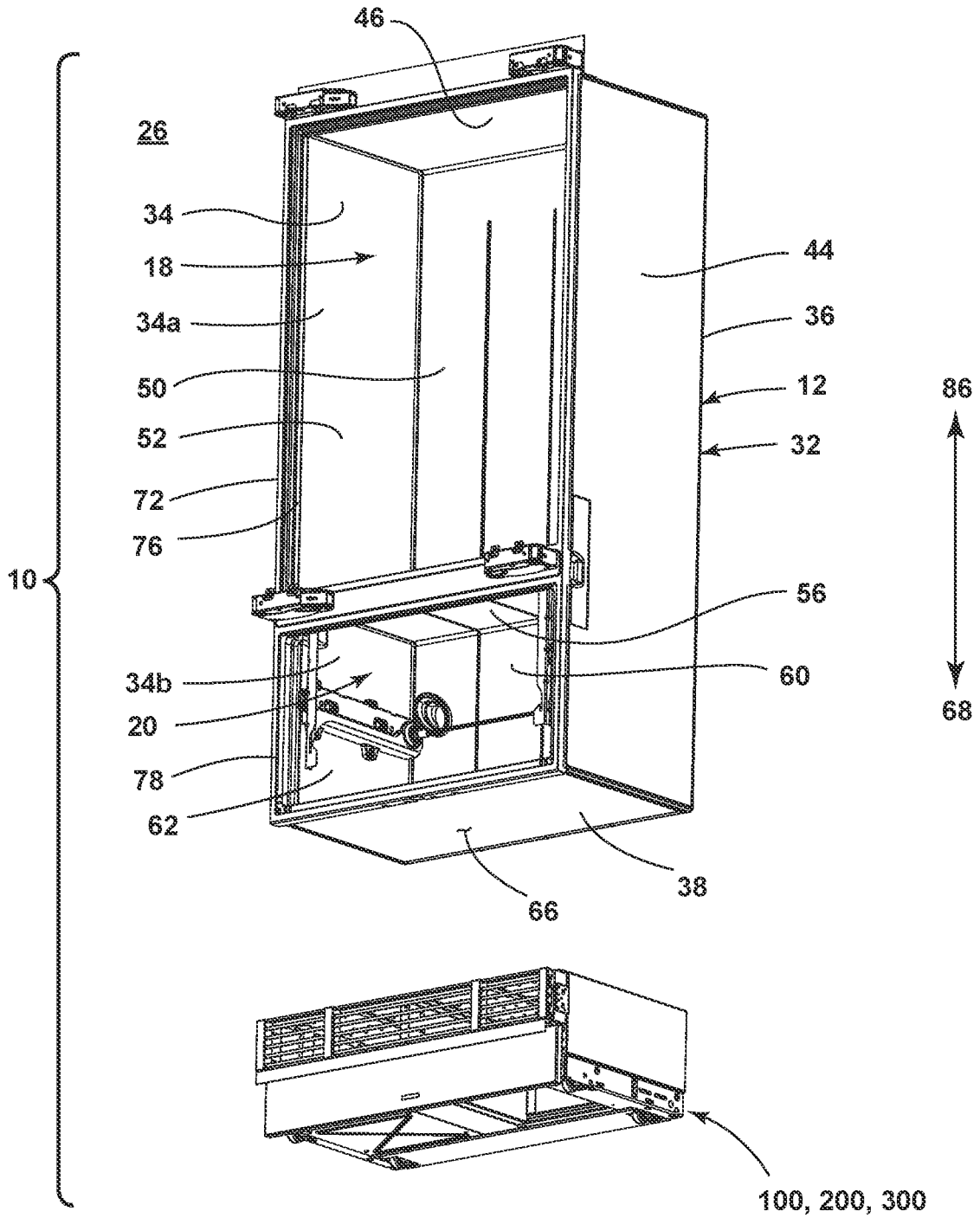
FIG. 9 is a partially exploded perspective view of the refrigerator of FIG. 1 without the doors and the drawer, illustrating the structural support supporting the bottom surface of the bottom wall of the outer wrapper of the vacuum-insulated structure of the cabinet.
Figure 10:
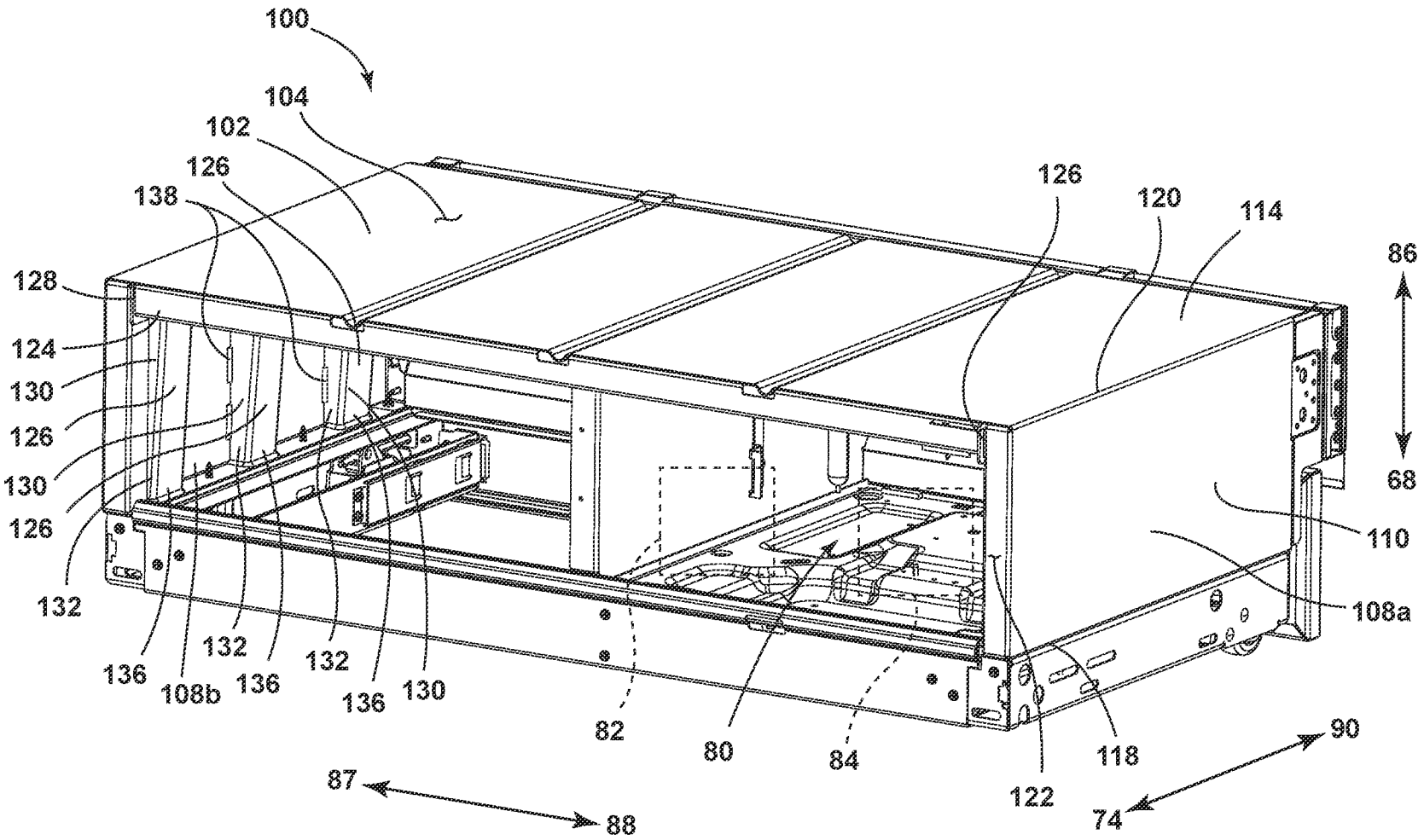
FIG. 10 is a front overhead perspective view of an embodiment of the structural support of the present disclosure for the refrigerator of FIG. 1, illustrating the structural support including a single piece of sheet metal forming the baseplate welded to the bottom surface of the bottom wall of the outer wrapper of the vacuum-insulated structure and opposing side panels disposed elevationally below the baseplate.
Figure 11:
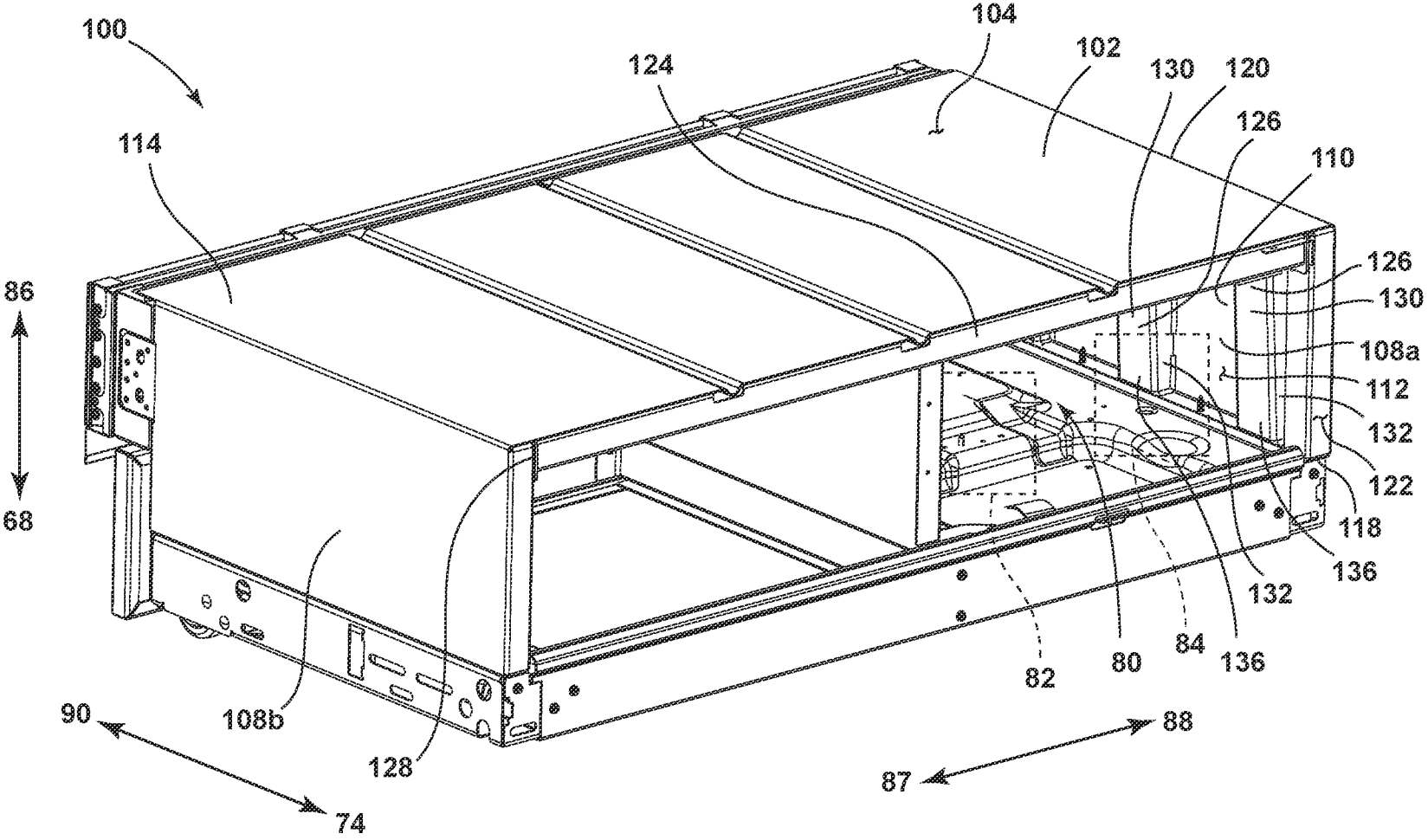
FIG. 11 is another front overhead perspective view of the embodiment of the structural support of FIG. 10, illustrating leg supports welded to an inward surface of the side panel, and the side panel disposed proximate the machine room that houses a compressor and a condenser.
Figure 12:
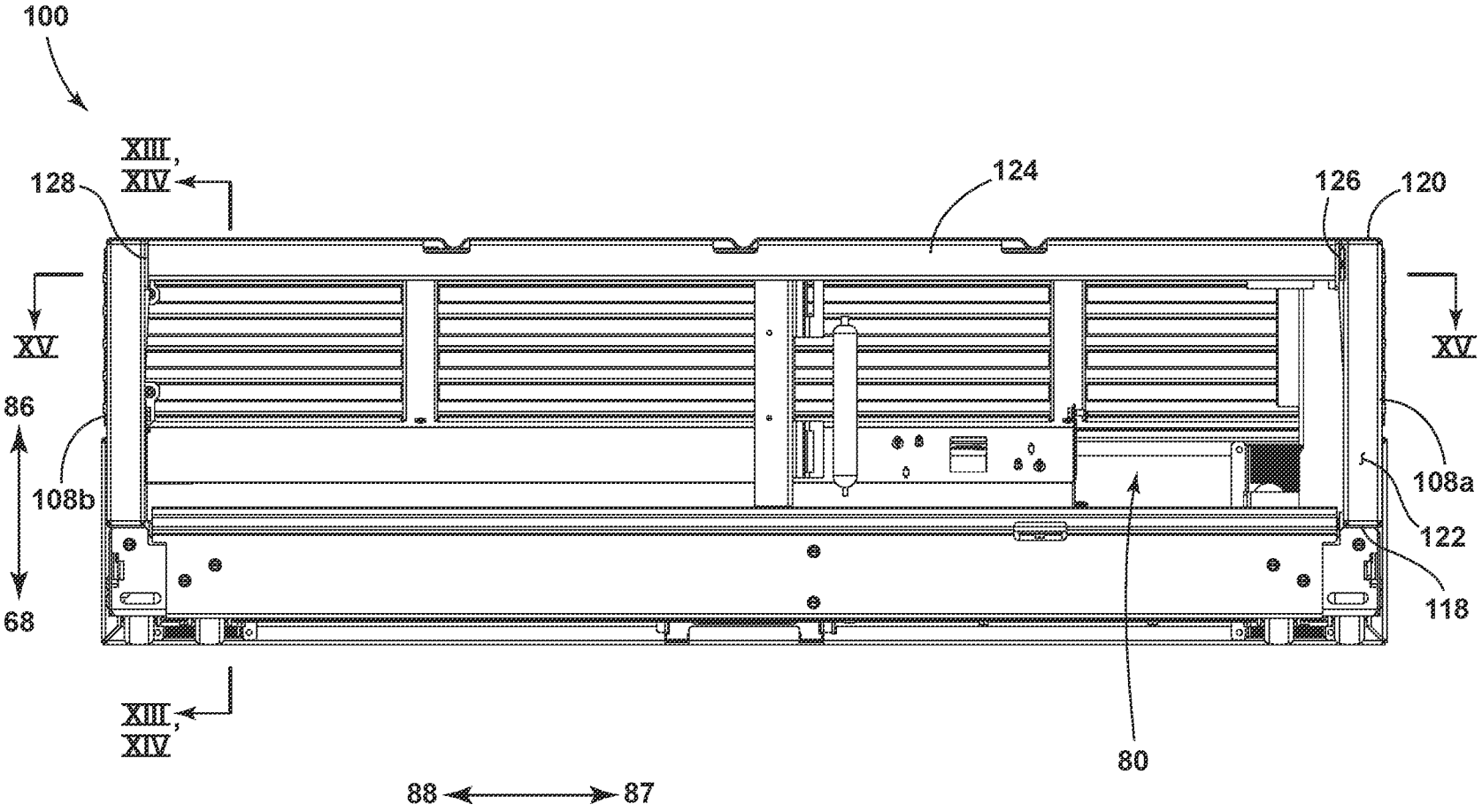
FIG. 12 is a rear elevational view of the structural support of FIG. 10, illustrating the structural support further including a cross-member disposed below the baseplate and attached to both of the opposing side panels.
Figure 13:
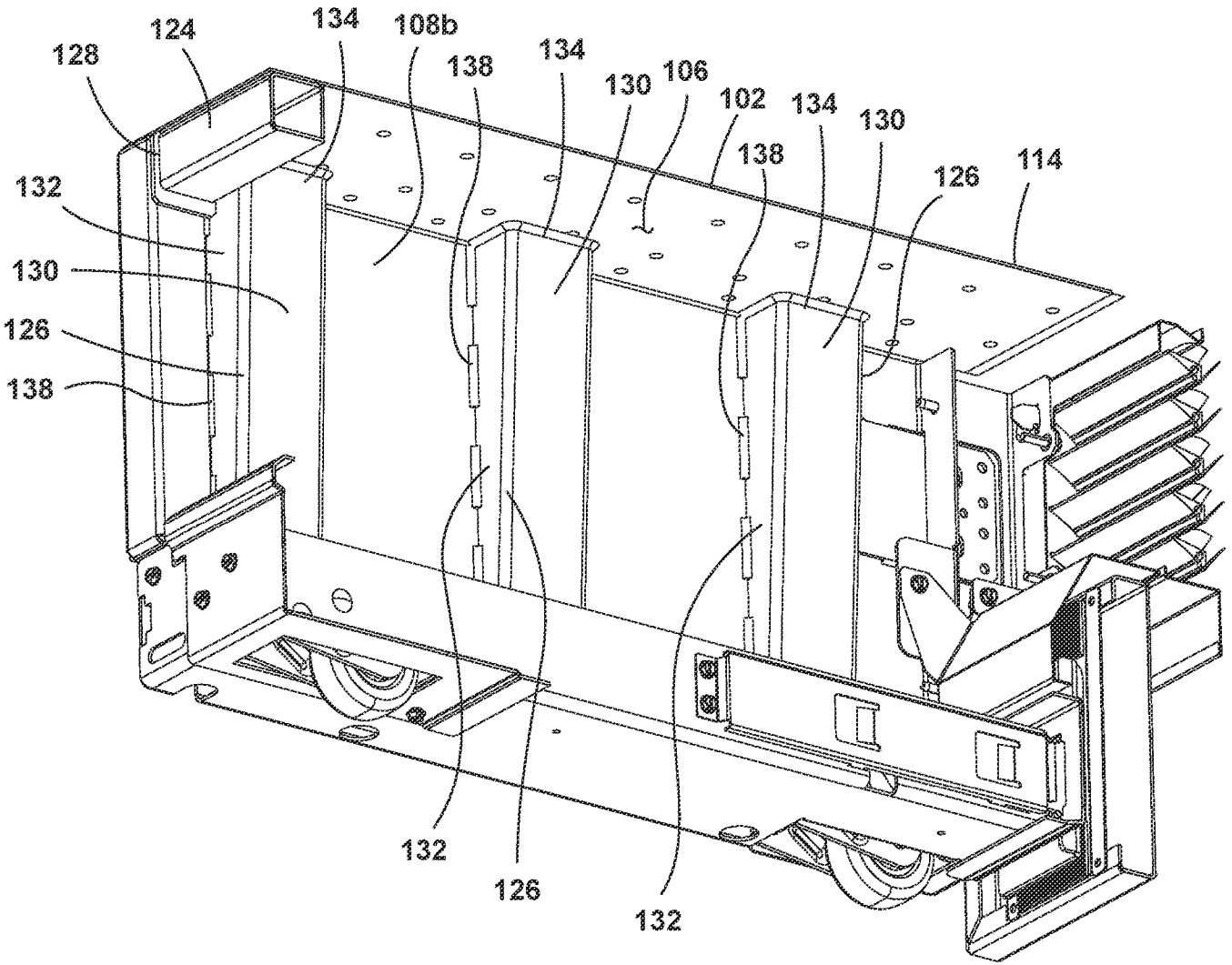
FIG. 13 is an underneath perspective view of a cross-section of the embodiment of the structural support of FIG. 10 taken through line XIII-XIII of FIG. 12, illustrating the leg supports welded to the side panel and a bottom surface of the baseplate, and the leg supports including a rear wall, a lateral wall, and a top, which is welded to the bottom surface of the baseplate.
Figure 14:
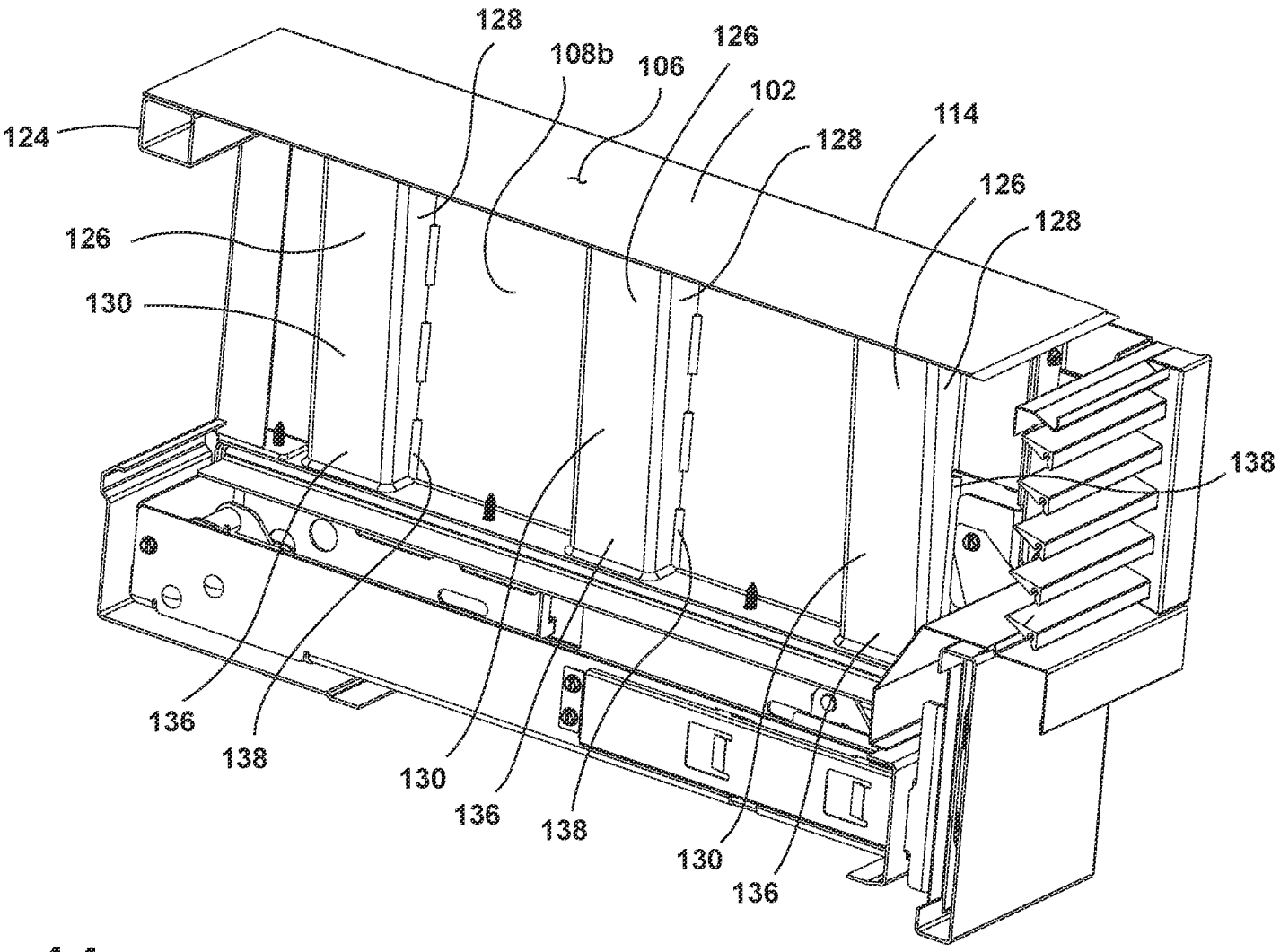
FIG. 14 is an overhead perspective view of a cross-section of the embodiment of the structural support of FIG. 10 taken through line XIV-XIV of FIG. 12, illustrating the leg supports including a forward wall opposing the rear wall and a bottom wall.
Figure 15:
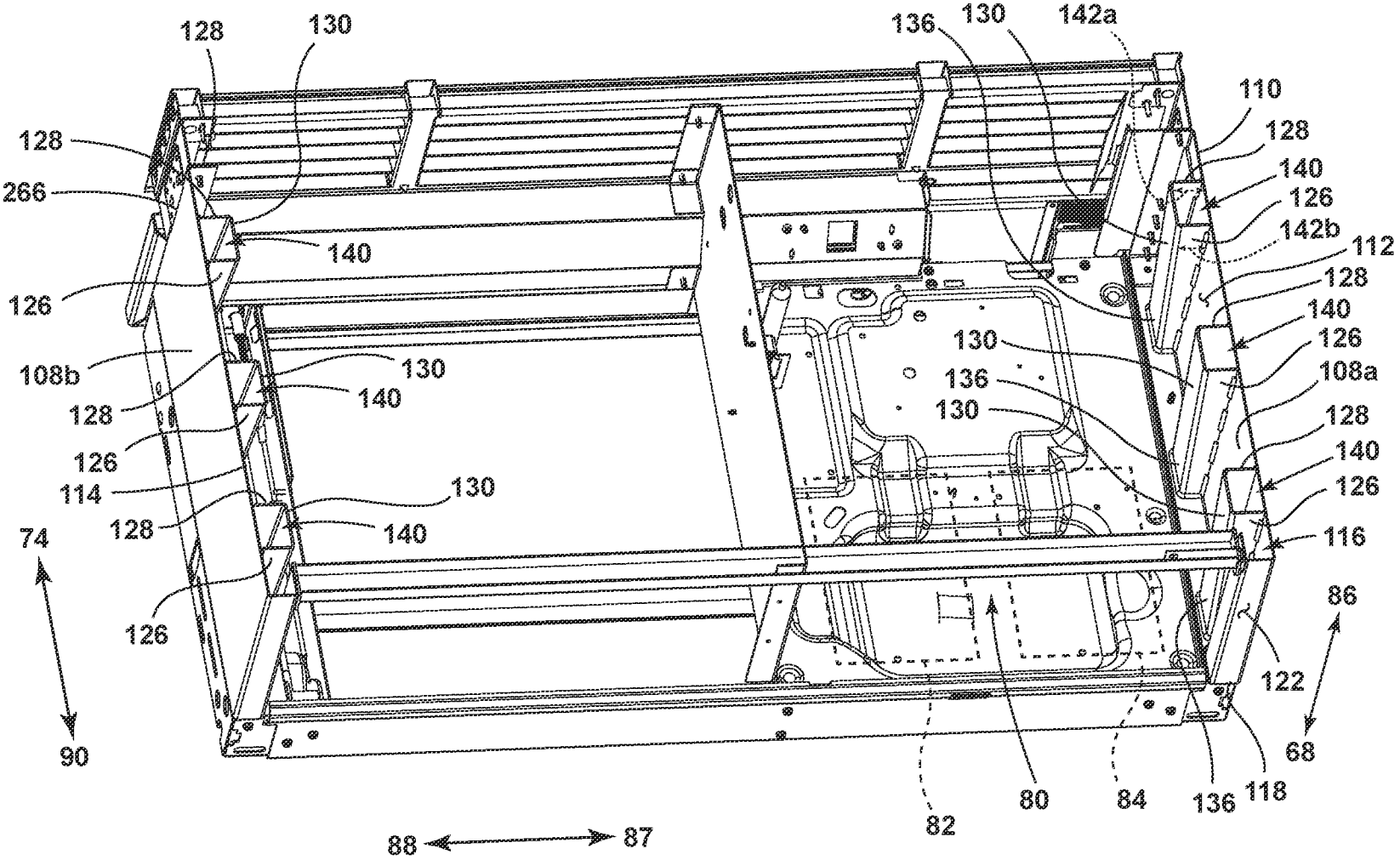
FIG. 15 is an overhead perspective view of a cross-section of the embodiment of the structural support of FIG. 10 taken through line XV-XV of FIG. 12, illustrating the leg supports forming a C-channel with the lateral wall of the leg support opposing the inward surface of the side panel, and lateral widths of the forward wall and the rear wall decreasing from the top to the bottom of the leg support.
Figure 16:
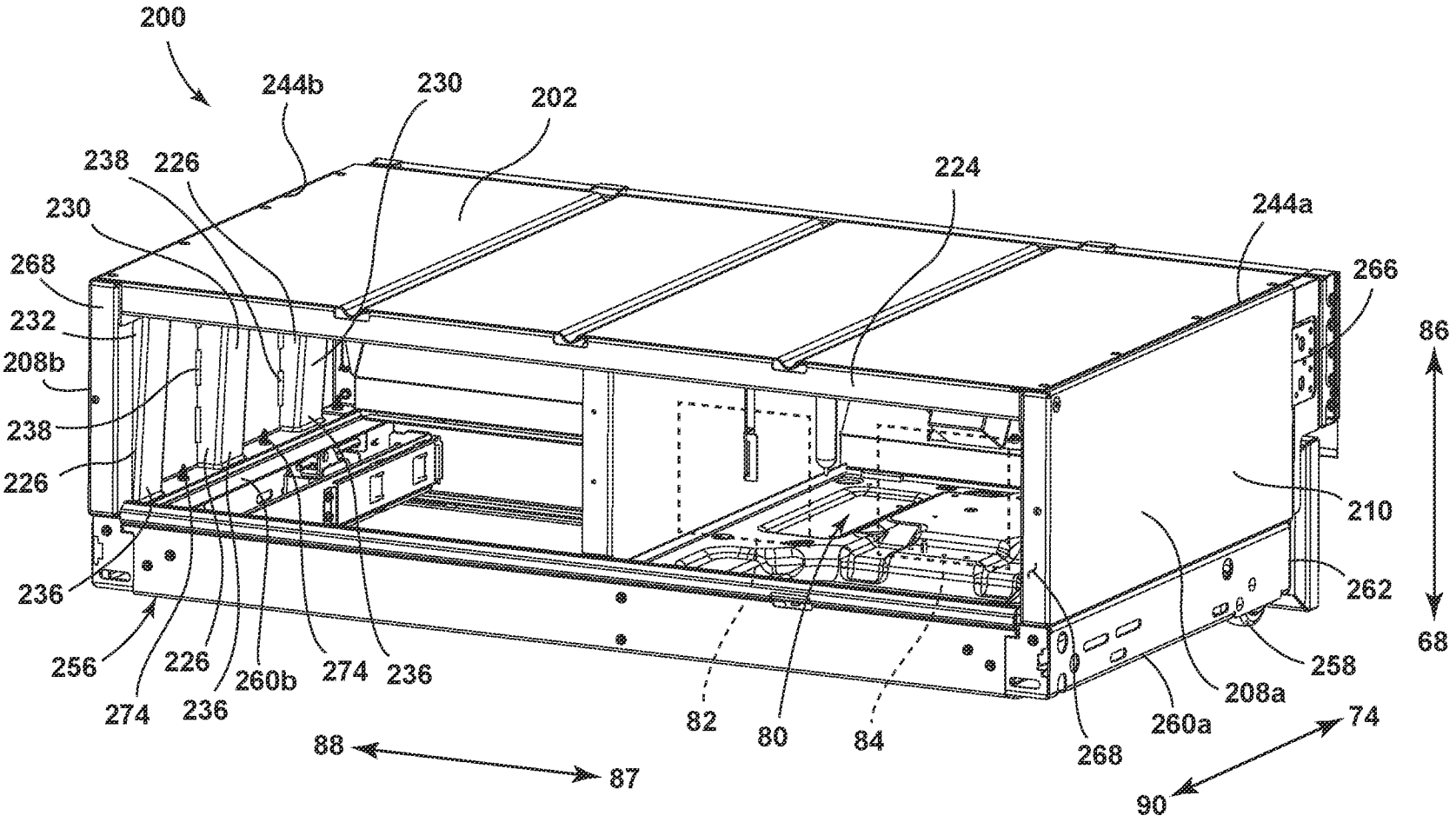
FIG. 16 is a front overhead perspective view of another embodiment of the structural support of the present disclosure for the refrigerator of FIG. 1, illustrating the structural support including opposing side panels attached to and disposed under side edges of a baseplate, which is welded the bottom surface of the bottom wall of the outer wrapper of the vacuum-insulated structure.
Figure 17:
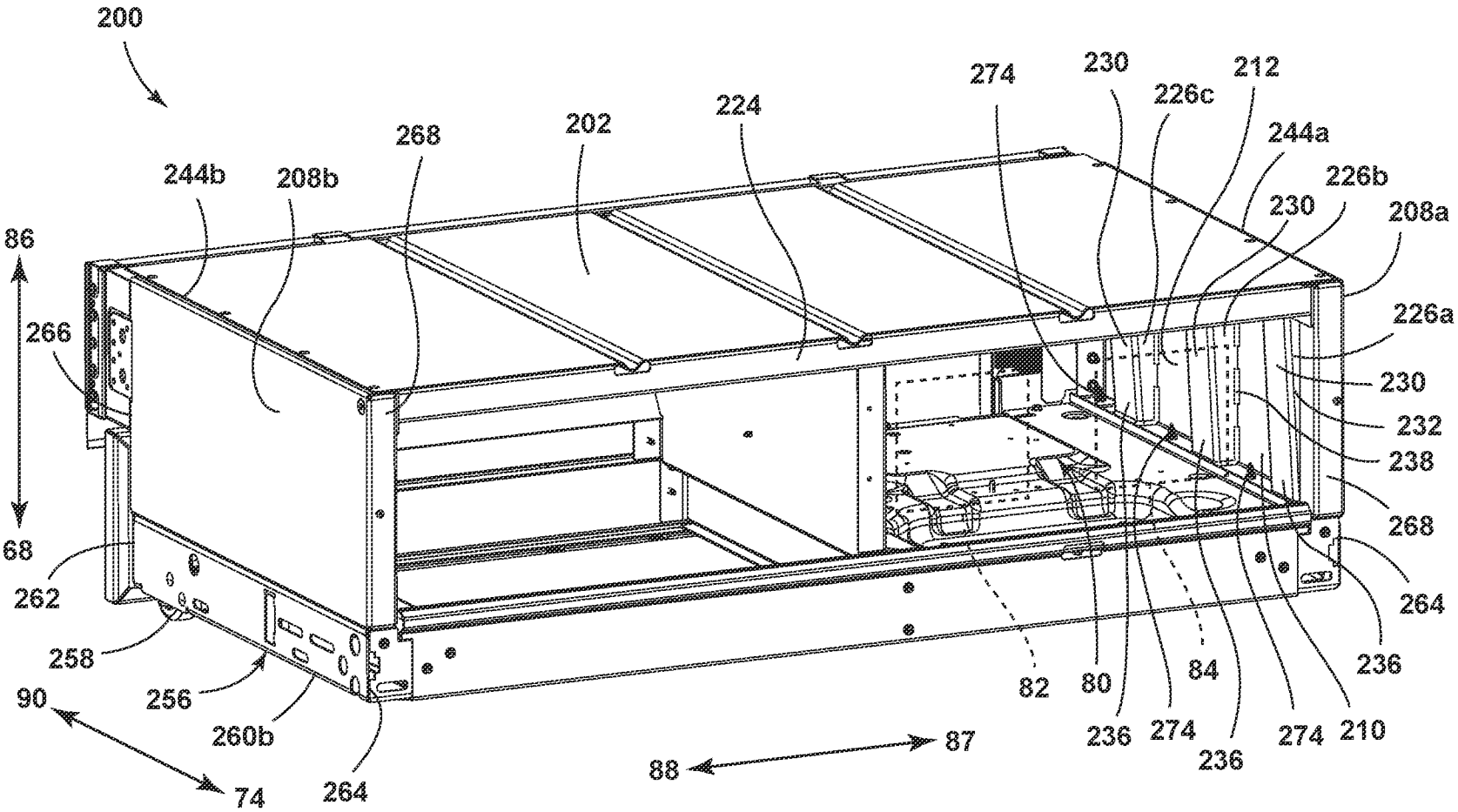
FIG. 17 is another front overhead perspective view of the embodiment of the structural support of FIG. 16, illustrating leg supports welded to an inward surface of the side panel, and the side panel disposed proximate the machine room that houses a compressor and a condenser.
Figure 18:
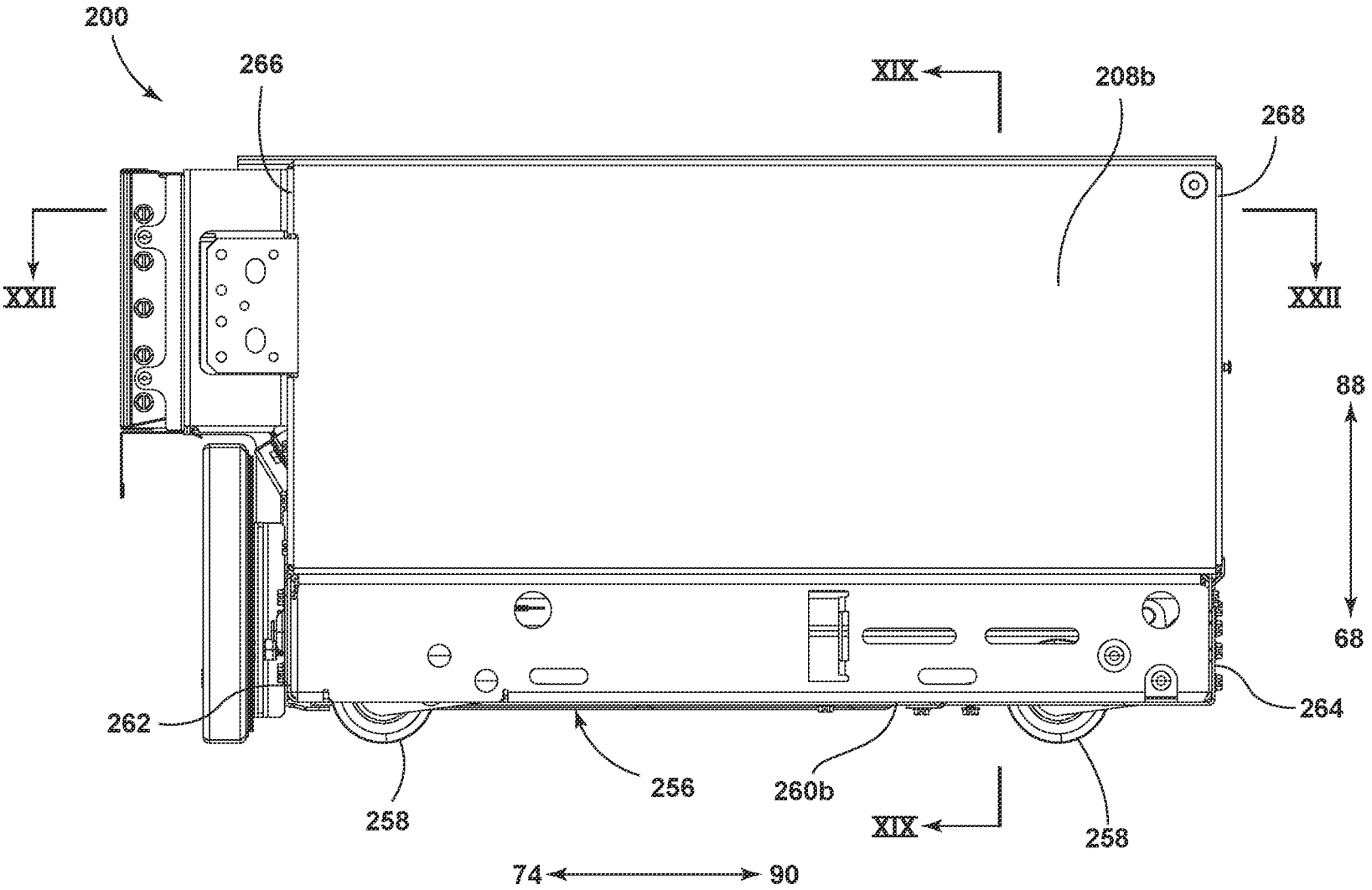
FIG. 18 is a side elevational view of the structural support of FIG. 16, illustrating a carriage with wheels disposed under the side panels.
Figure 19:
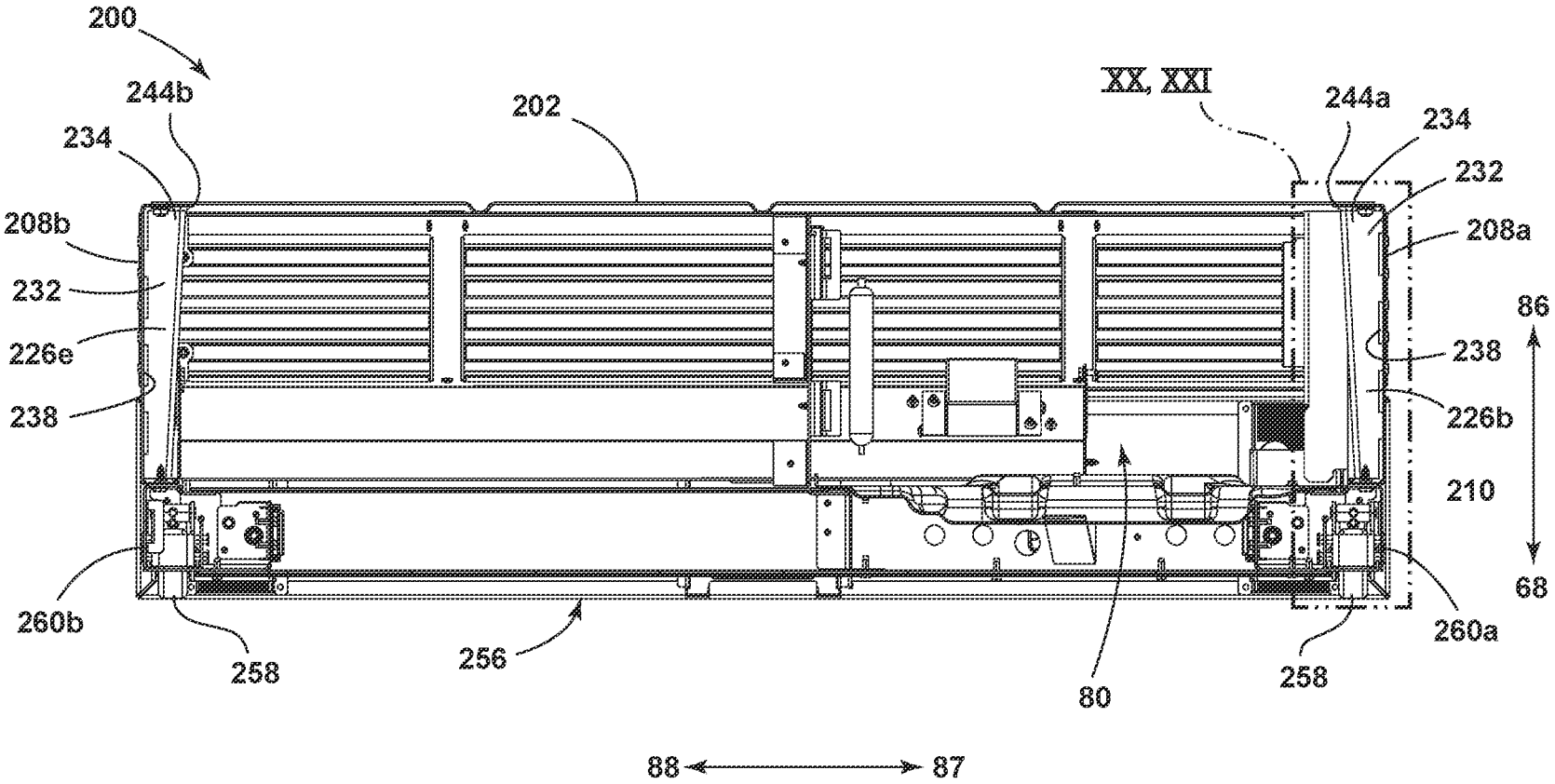
FIG. 19 is a rear elevational view of a cross-section of the structural support of FIG. 16 taken through line XIX-XIX of FIG. 18, illustrating a top of the leg supports welded to top lips of the side panel and a bottom of the leg supports welded to bottom lips of the side panel.
Figure 20:
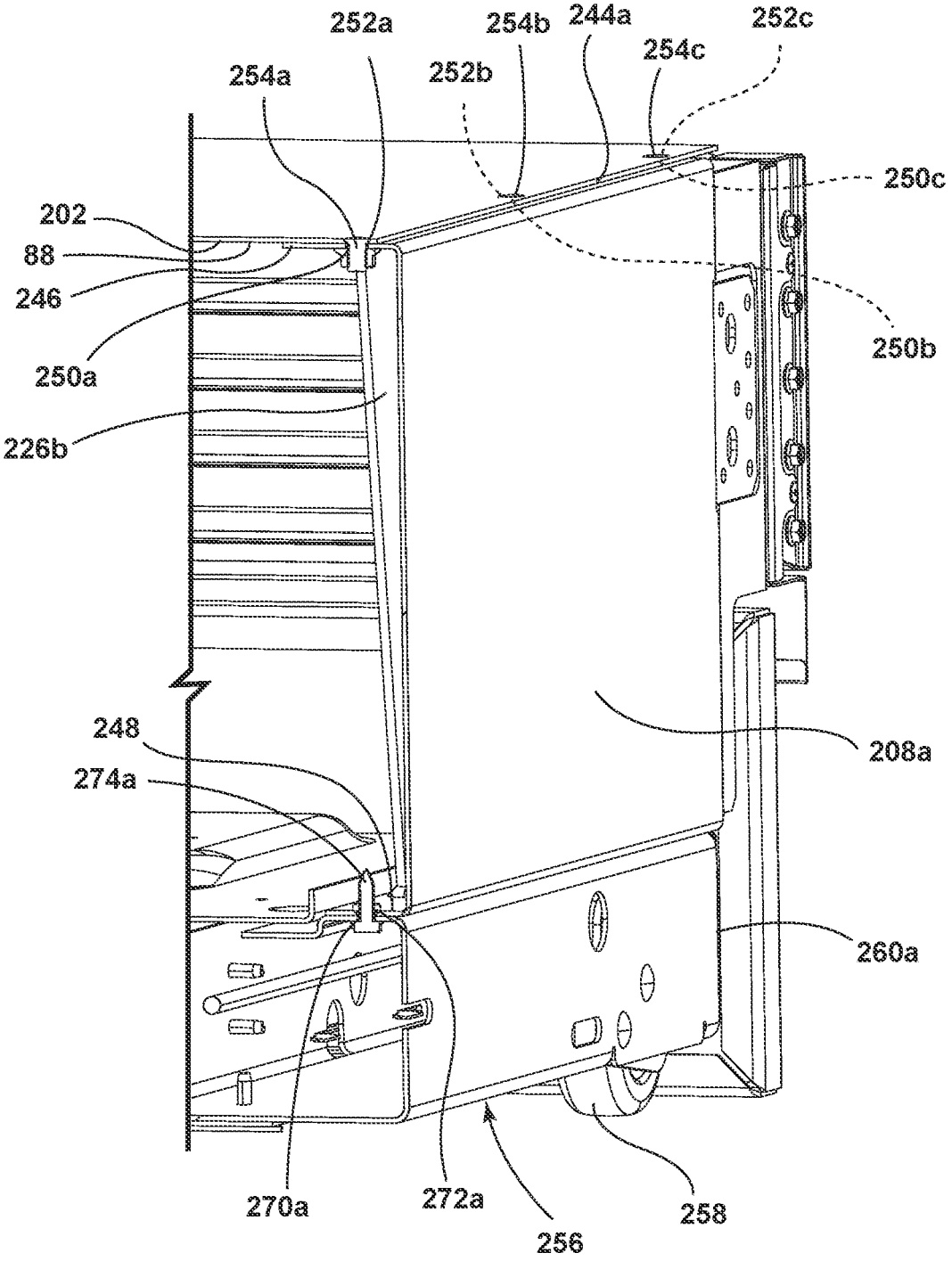
FIG. 20 is a magnified perspective view of area XX of FIG. 19, illustrating a fastener extending through aligned apertures through the baseplate and the top lip of the side panel to fasten them together, and a fastener extending through aligned apertures through the bottom lip of the side panel and a horizontal section of the carriage to fasten them together.
Figure 21:
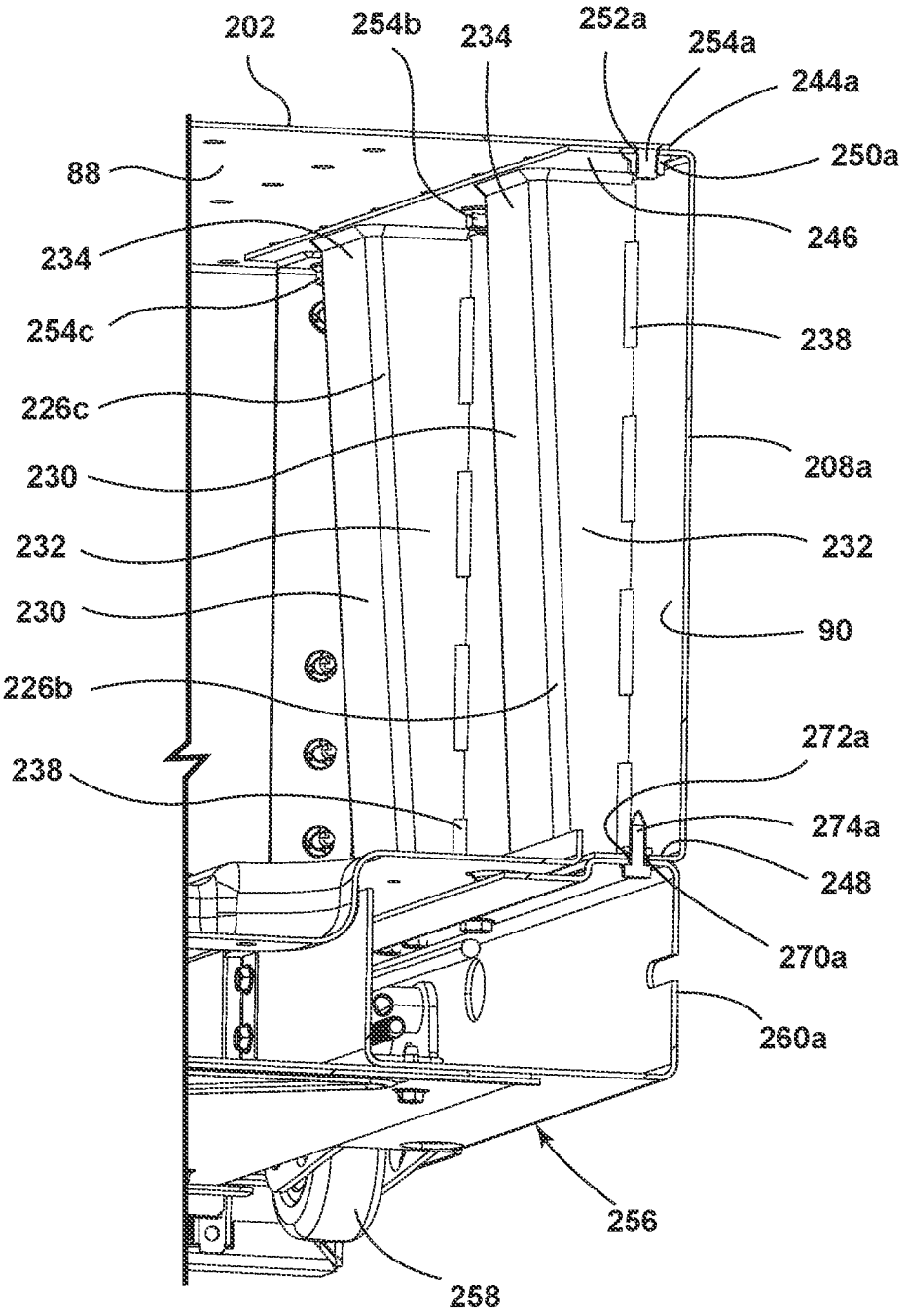
FIG. 21 is a magnified perspective view of area XXI of FIG. 19, illustrating the baseplate defining a ceiling of the machine room.
Figure 22:
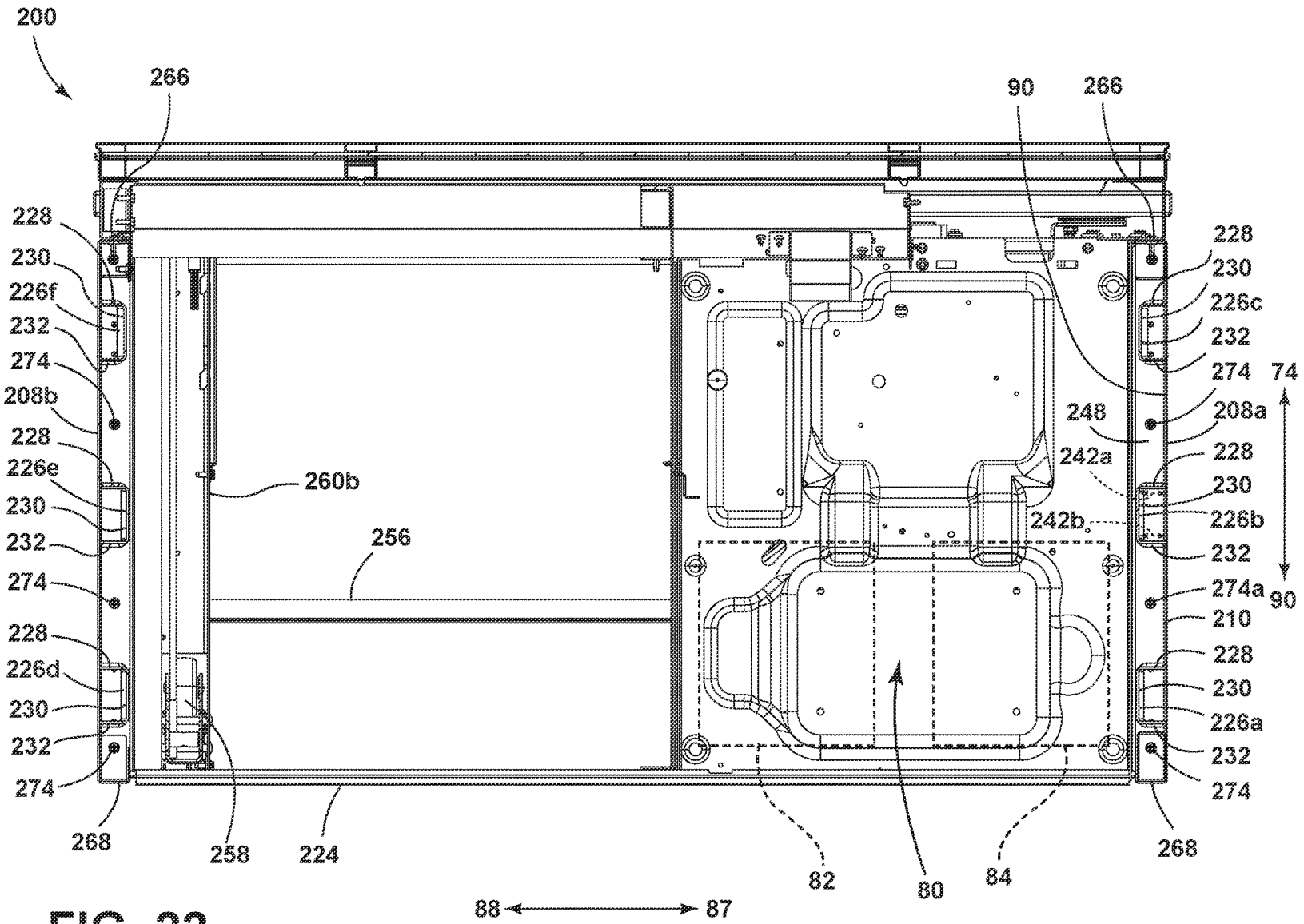
FIG. 22 is an overhead plan view of a cross-section of the embodiment of the structural support of FIG. 16 taken through line XXII-XXII of FIG. 18, illustrating the structural support further including a cross-member connected to rears of the opposing side panels.
Figure 23:
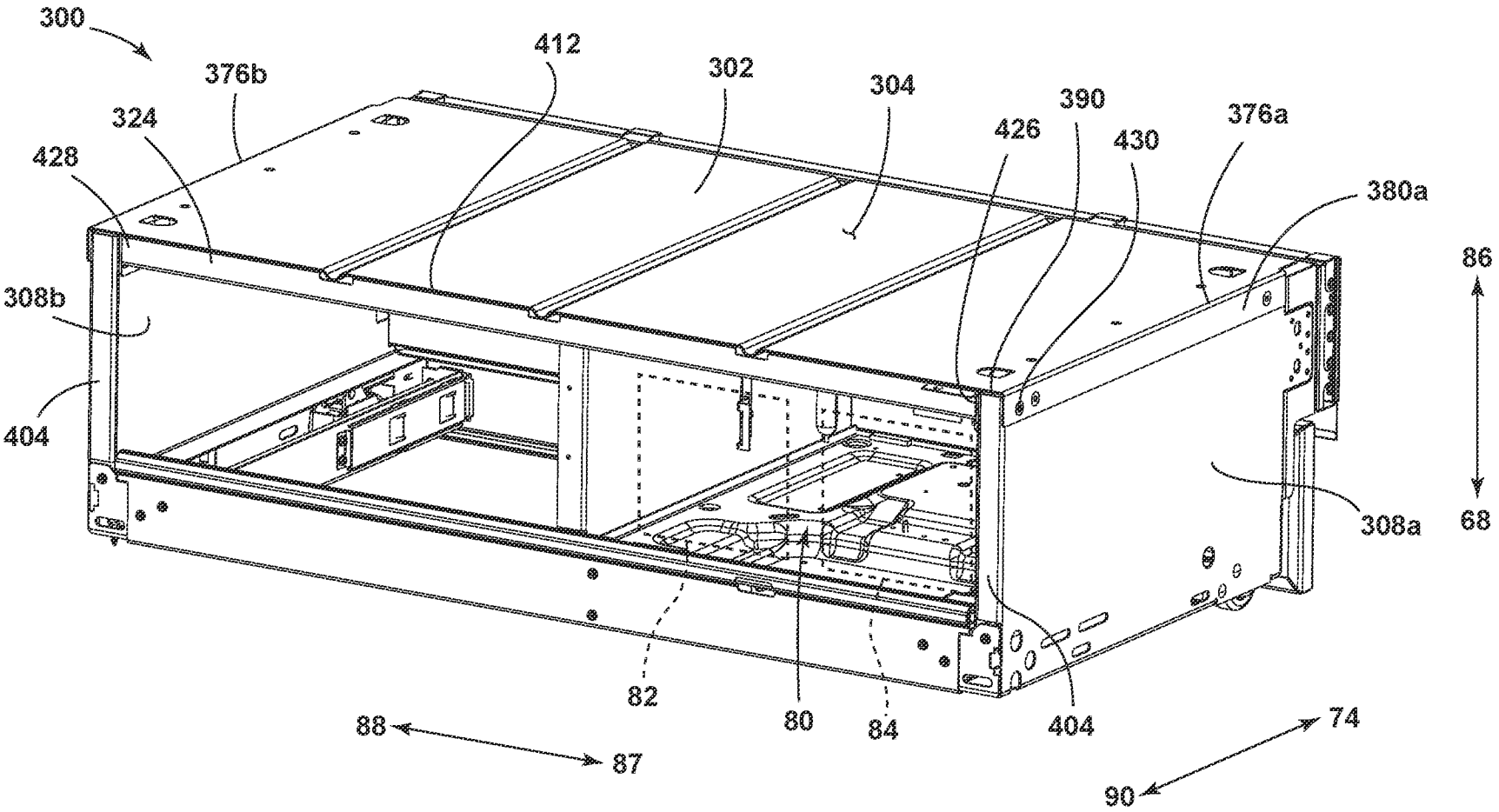
FIG. 23 is a rear overhead perspective view of another embodiment of the structural support of the present disclosure for the refrigerator of FIG. 1, illustrating the structural support including opposing side panels supporting a baseplate with lips of the baseplate extending laterally over top walls of the side panels.
Figure 24:
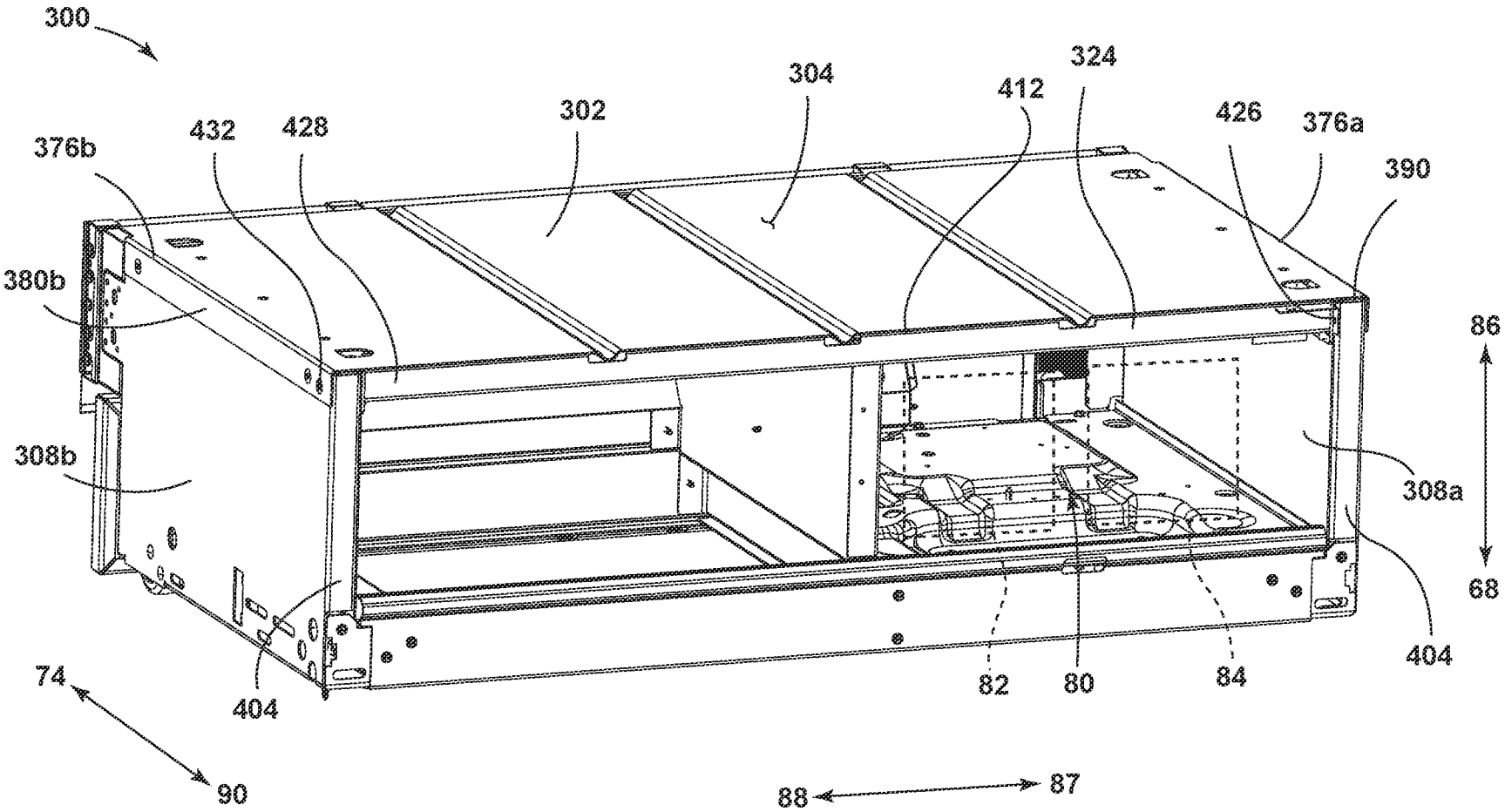
FIG. 24 is another rear overhead perspective view of the embodiment of the structural support of FIG. 23, illustrating the structural support further including a cross-member under the baseplate attached to the side panels.
Figure 25:
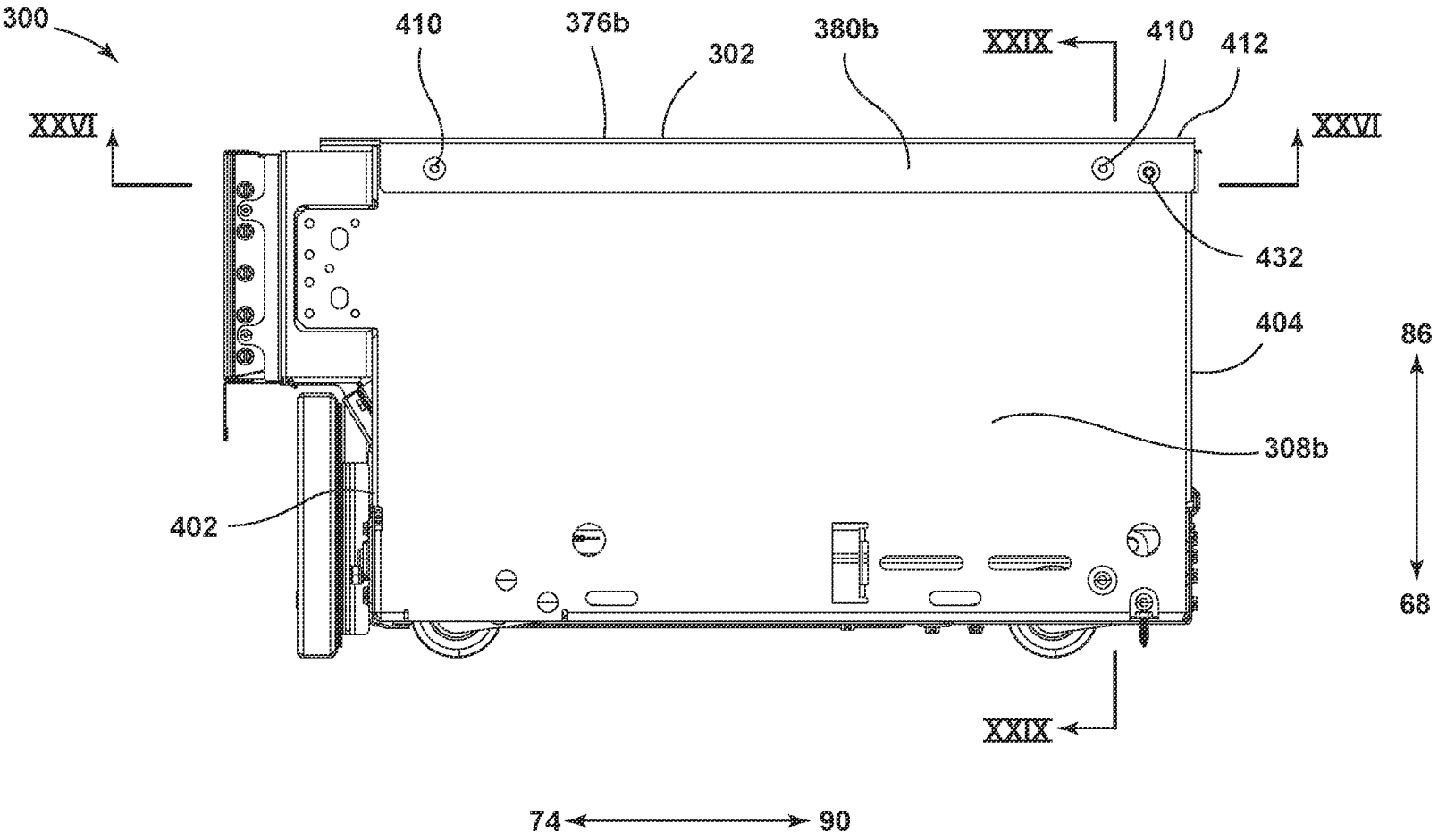
FIG. 25 is a side elevational view of the embodiment of the structural support of FIG. 23, illustrating fasteners extending through lips of the baseplate and the side panels to fasten them together.
Figure 26:
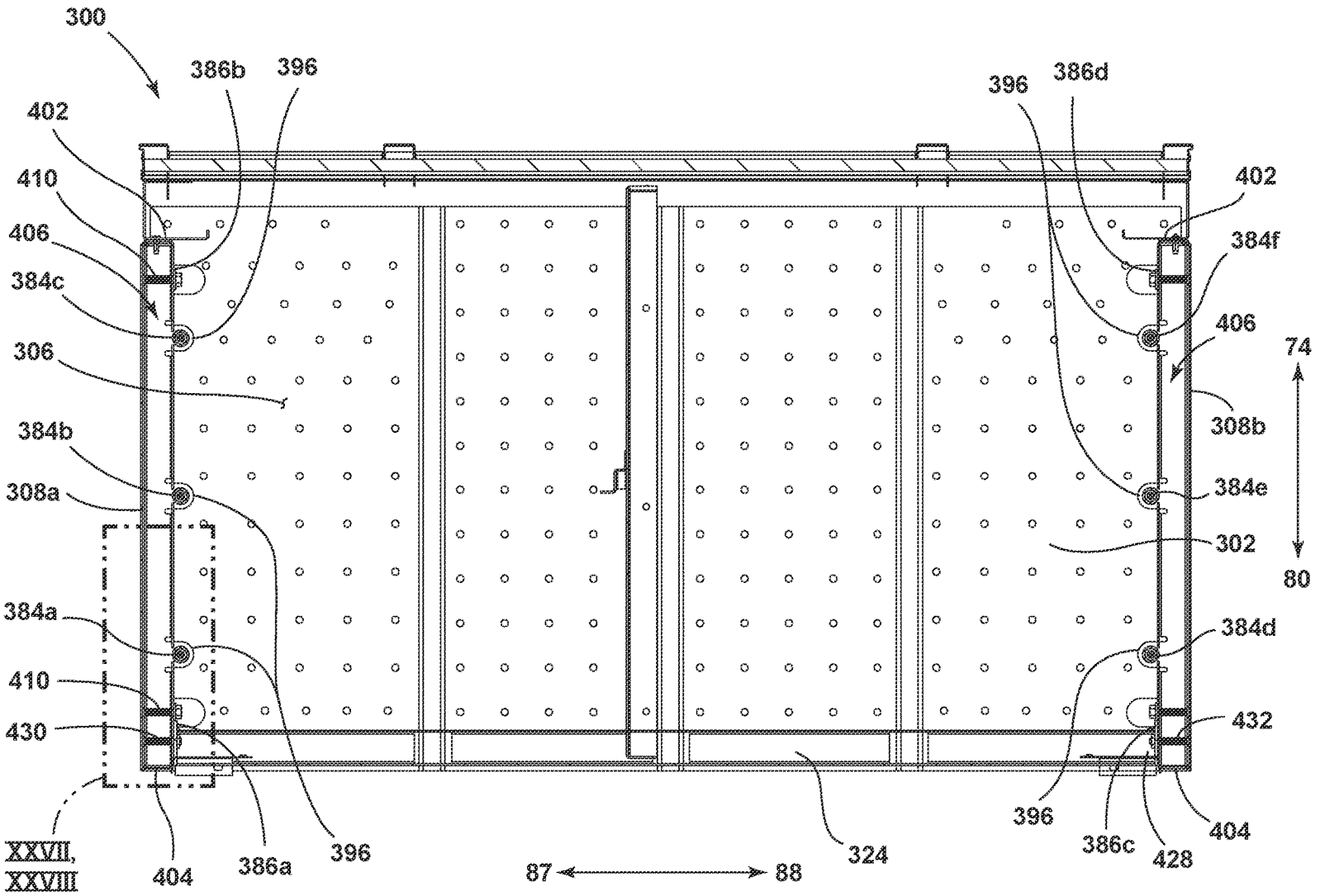
FIG. 26 is an underneath view of a cross-section of the structural support of FIG. 23 taken through line XVI-XVI of FIG. 25, illustrating the baseplate including clinch studs that extend downward from the bottom surface of the baseplate, and the side panels including tabs with apertures to receive the clinch studs to attach the side panels and the baseplate further together.
Figure 27:
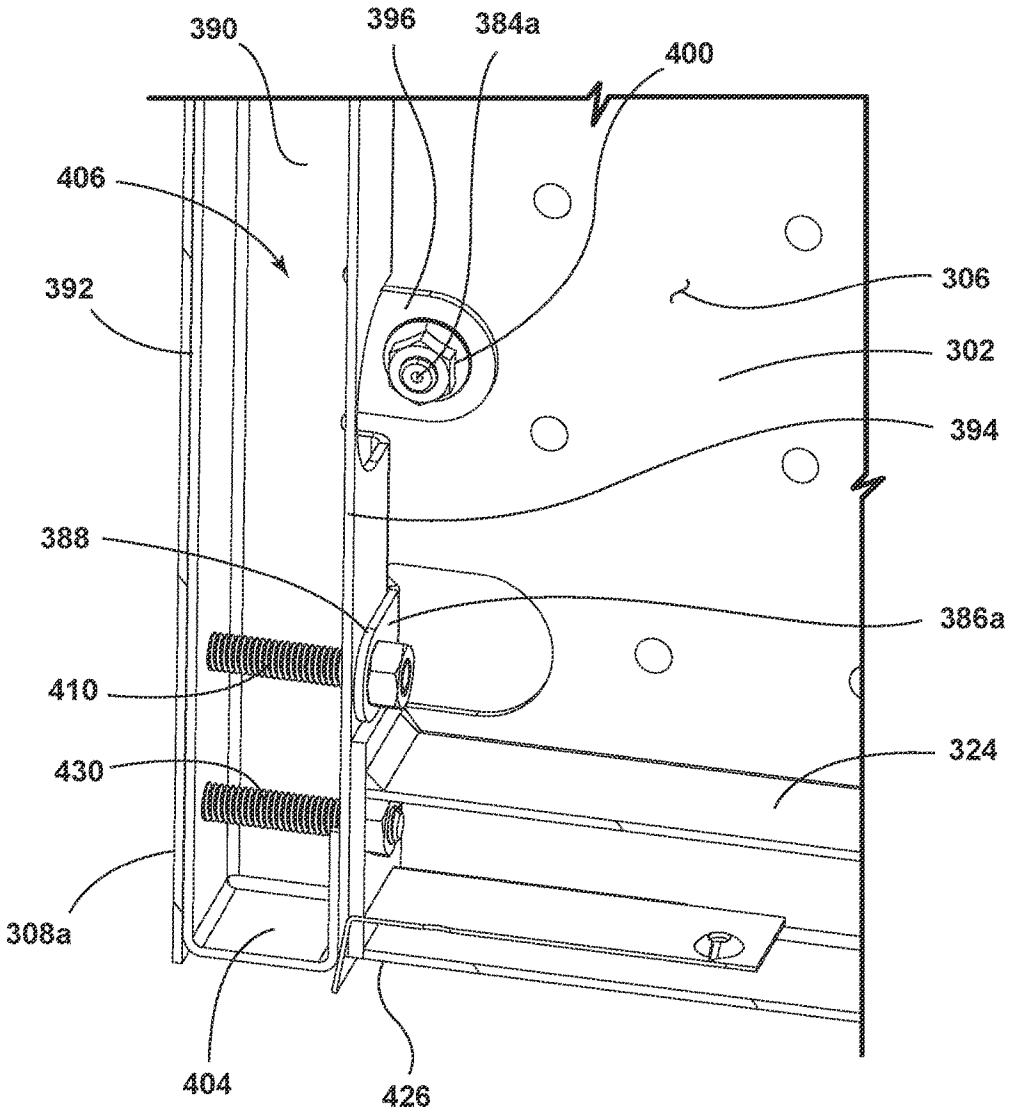
FIGS. 27 and 28 are magnified perspective views of areas XXVII and XXVIII, respectively, of FIG. 26, illustrating the fastener extending through the lip of the baseplate, the outer side wall of the side panel, the inner side wall of the side panel, and a tab of the baseplate (opposing the lip of the baseplate) to fasten the baseplate and the side panel together.
Figure 28:
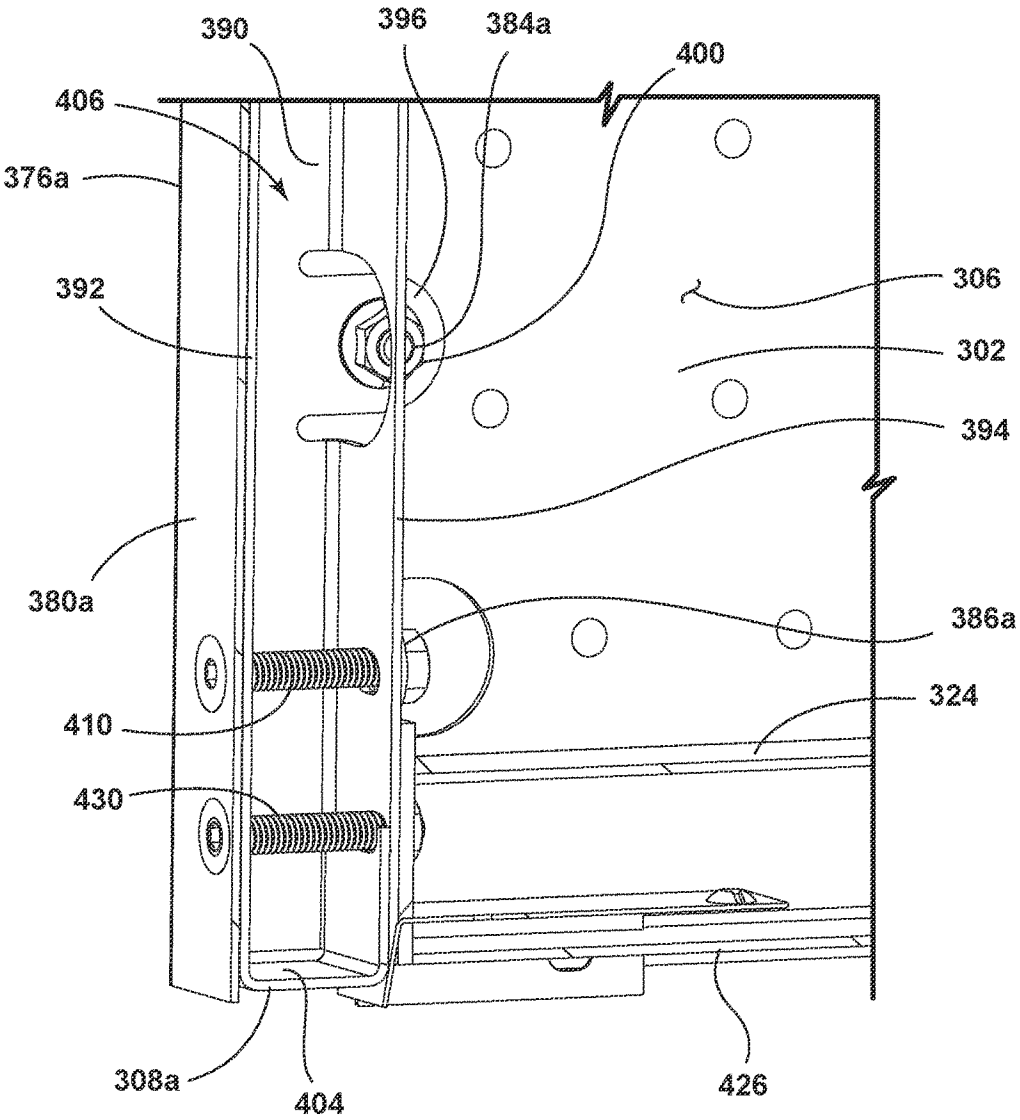
Figure 29:
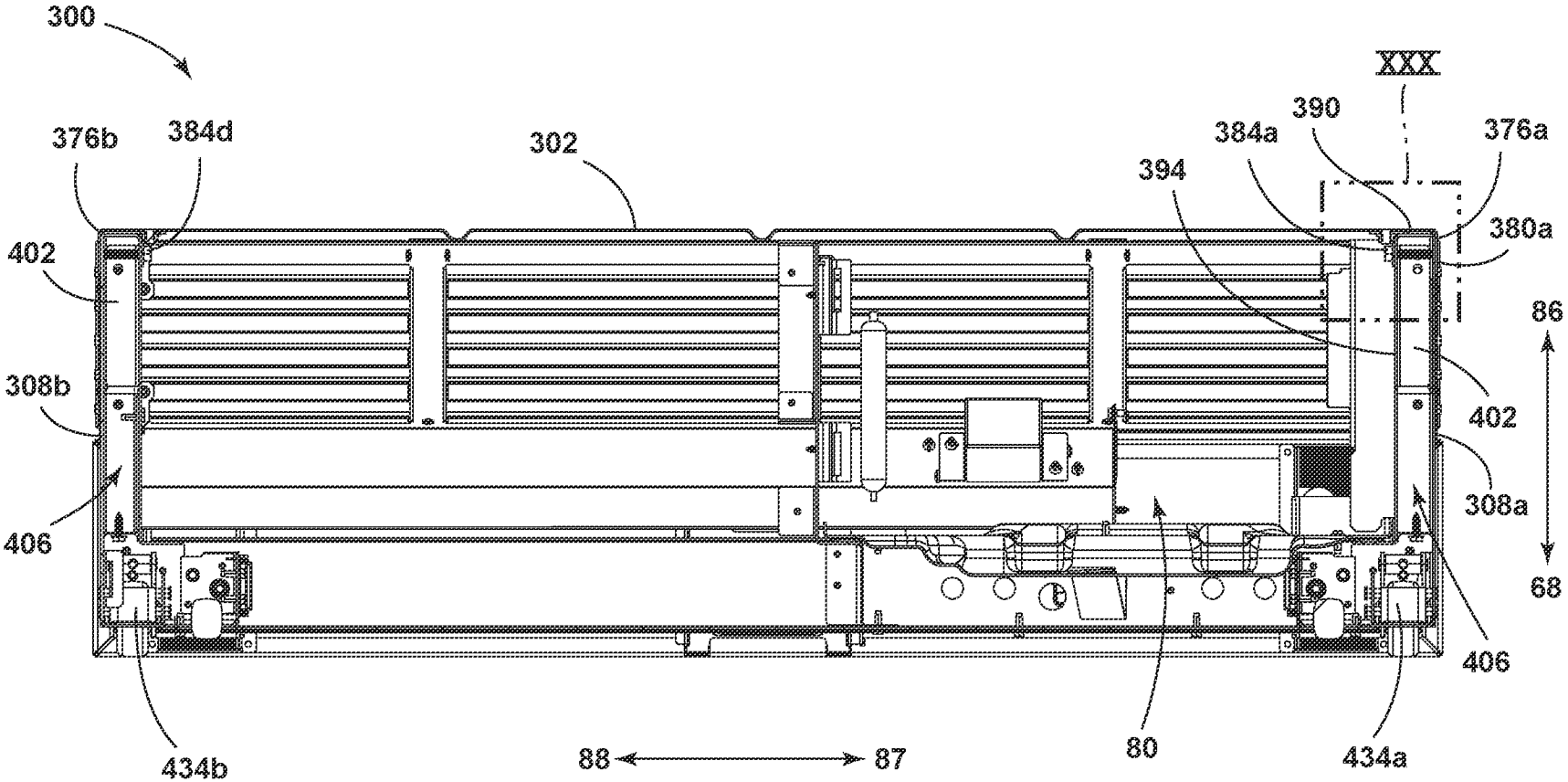
FIG. 29 is a rear elevational view of a cross-section of the structural support of FIG. 23, taken through line XXIX-XXIX of FIG. 25, illustrating the side panels including a space between the inner side wall and the outer side wall thereof.
Figure 30:
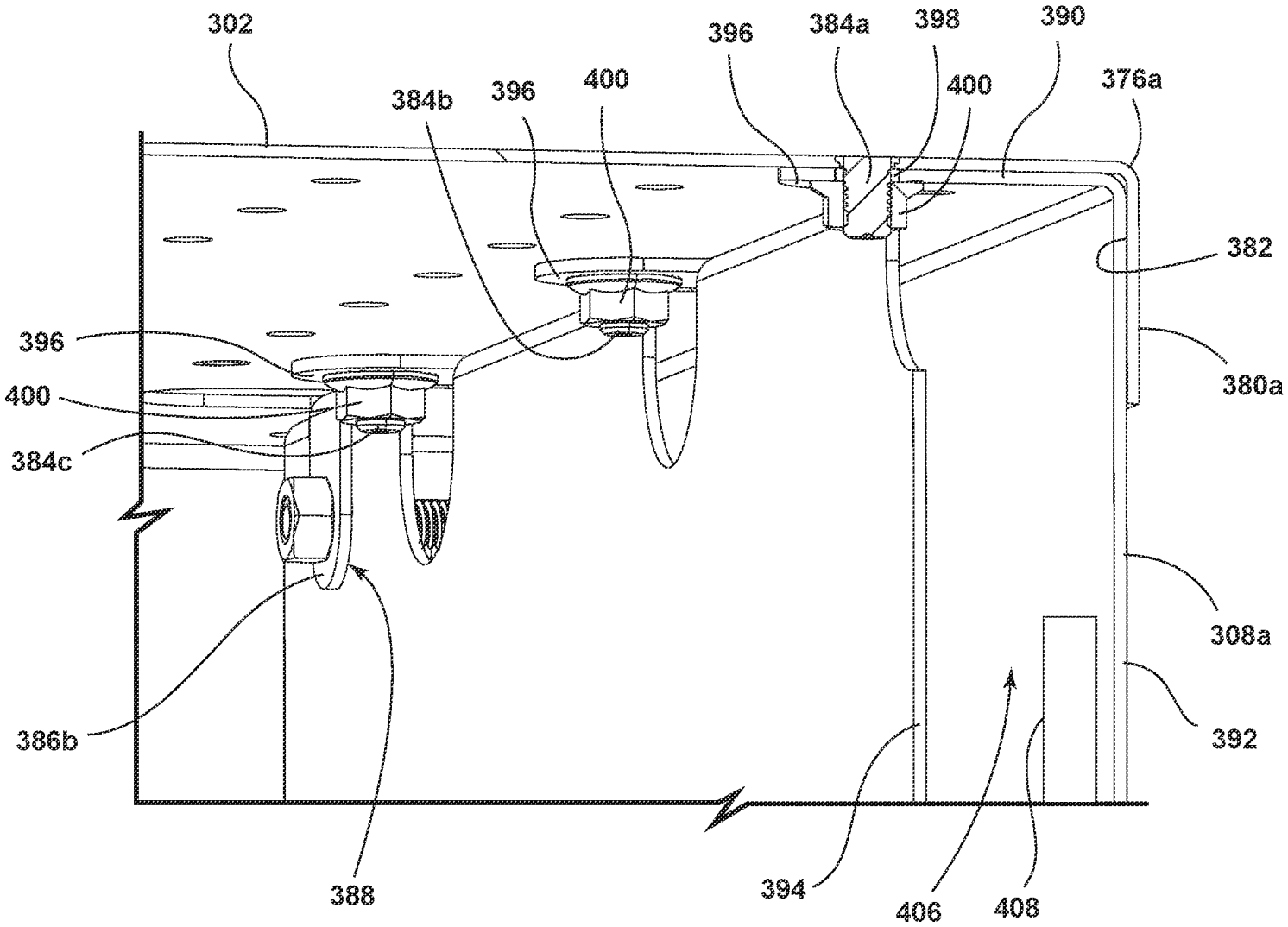
FIG. 30 is a magnified perspective view of area XXX of FIG. 29, illustrating foam disposed within the space of the side panel.

Referring to FIG. 1-2, a refrigerator 10 includes a cabinet 12 and one or more of a door 14 and a drawer 16 associated with the cabinet 12. The cabinet 12 houses one or more of a refrigeration compartment 18 and a freezer compartment 20. Any of the doors 14 and drawers 16 associated with the cabinet 12 are movable to, from, and between a closed position 22 (FIG. 1) and an open position 24 (FIG. 2). In the closed position 22, the door 14 and/or drawer 16, as the case may be, denies access to the one or more of the refrigeration compartment 18 and the freezer compartment 20 from an external environment 26. In the open position 24, the door 14 and/or drawer 16, as the case may be, allows access to the one or more of the refrigeration compartment 18 and the freezer compartment 20 from the external environment 26. The external environment 26 can be that provided within a kitchen 28. The refrigerator 10 can be of the built-in variety, as illustrated, where the cabinet 12 is recessed into cabinetry 30. However, the refrigerator 10 can be of the stand alone variety. Further, the refrigerator 10 can take any of multiple configurations such as a French door configuration (as illustrated), side-by-side (where the refrigeration compartment 18 and the freezer compartment 20 are side-by-side), and so on.

Referring additionally to FIGS. 3-9, the refrigerator 10 includes a vacuum-insulated structure 32. The vacuum-insulated structure 32 includes at least an inner liner 34 and an outer wrapper 36. In embodiments, such as that illustrated, the vacuum-insulated structure 32 includes a first inner liner 34*a* (as the inner liner 34) and a second inner liner 34*b*. The first inner liner 34*a* defines the refrigeration compartment 18. The second inner liner 34*b*, which is disposed below the first inner liner 34*a*, defines the freezer compartment 20. In embodiments where only the first inner liner 34*a* (as the inner liner 34) is included, the first inner liner 34*a* defines either the refrigeration compartment 18 or the freezer compartment 20. The refrigeration compartment 18, in use, can be maintained at a temperature above the freezing point of water but below ambient temperature. The refrigeration compartment 18 can be used to store fresh food. The freezer compartment 20, in use, can be maintained at a temperature below the freezing point of water in order to maintain food in a frozen state. In the illustrated embodiment, the first inner liner 34*a* is disposed above the second inner liner 34*b*. However, in other embodiments, the first inner liner 34*a* and the second inner liner 34*b* can be disposed side-by-side.

In any event, the outer wrapper 36 at least partially envelopes the first inner liner 34*a* as well as the second inner liner 34*b*, if included. For example, the outer wrapper 36 can include a top wall 37, a bottom wall 38, a rear wall 40, and opposing side walls 42, 44. Similarly, the first inner liner 34*a* can include a top wall 46, a bottom wall 48, a rear wall 50, and opposing side walls 52, 54. Likewise, the second inner liner 34*b* can include a top wall 56, a bottom wall 58, a rear wall 60, and opposing side walls 62, 64. The rear wall 40 of the outer wrapper 36 is disposed rearward 90 of the rear wall 50 of the first inner liner 34*a* and the rear wall 60 of the second inner liner 34*b*. The top wall 37 of the outer wrapper 36 is disposed above the top wall 46 of the first inner liner 34*a* and the top wall 56 of the second inner liner 34*b*. The bottom wall 38 of the outer wrapper 36 is disposed below the bottom wall 48 of the first inner liner 34*a* and the bottom wall 58 of the second inner liner 34*b*. The side walls 52, 54 of the first inner liner 34*a* and the side walls 62, 64 of the second inner liner 34*b* are disposed between the side walls 42, 44 of the outer wrapper 36. The bottom wall 38 of the outer wrapper 36 presents a bottom surface 66 that faces downward 68.

A space 70 separates the outer wrapper 36 from the first inner liner 34*a* and the second inner liner 34*b*, as well as the first inner liner 34*a* from the second inner liner 34*b*. The vacuum-insulated structure 32 can further include a trim breaker 72 coupled to all of the first inner liner 34*a*, the second inner liner 34*b*, and the outer wrapper 36. The trim breaker 72 seals the space 70. The trim breaker 72 can be disposed forward 74 of the first inner liner 34*a*, the second inner liner 34*b*, and the outer wrapper 36. The trim breaker 72 defines an opening 76 into the refrigeration compartment 18 that the first inner liner 34*a* defines and an opening 78 into the freezer compartment 20 that the second inner liner 34*b* defines. The doors 14 cover the opening 76 into the refrigerator compartment 18 when the doors 14 are in the closed position 22 but reveal the opening 76 to the external environment 26 when the doors 14 are in the open position 24. The drawer 16 covers the opening 78 into the freezer compartment 20 when the drawer 16 is in the closed position 22 but reveals the opening 78 to the external environment 26 when the drawer 16 is in the closed position 22.

The refrigerator 10 further includes a structural support 100, 200, or 300. The structural support 100, 200, or 300 both supports at least a portion of a weight of the cabinet 12 and defines a machine room 80. Components of the refrigerator 10 used to maintain the refrigerator compartment 18 and the freezer compartment 20 at their desired respective temperatures are housed in the machine room 80, such as a compressor 82 and a condenser 84, although other components can be included in the machine room 80 as well. Several embodiments of the structural support 100, 200, or 300 are further described herein.

Referring now to FIGS. 10-15, in embodiments, the structural support 100 includes a baseplate 102. The baseplate 102 is horizontally oriented. For example, the baseplate 102 includes a top surface 104 facing upward 86 and a bottom surface 106 facing downward 68. At least a portion of the top surface 104 can form a horizontal plane. At least a portion of the bottom surface 106 can form a horizontal plane slightly below the horizontal plane that the top surface 104 forms. The baseplate 102 is welded to the bottom surface 66 of the bottom wall 38 of the outer wrapper 36. The top surface 104 of the baseplate 102 faces and can contact the bottom surface 66 of the bottom wall 38 of the outer wrapper 36. The baseplate 102 can be formed of a sheet metal that is weldable.

The structural support 100 further includes side panels 108*a*, 108*b*. The side panel 108*a* is disposed laterally outward of the baseplate 102 in one lateral direction 87, while the side panel 108*b* is disposed laterally outward of the baseplate 102 in another lateral direction 88. The side panels 108*a*, 108*b* thus oppose each other. The side panels 108*a*, 108*b*, for purposes of the features described herein, are mirror images of each other. Thus, only the side panel 108*a* will be particularly discussed, although any feature discussed for the side panel 108*a* applies equally as well to the side panel 108*b*.

The side panel 108*a* includes a lateral wall 110 that presents an inward surface 112. The inward surface 112 of the lateral wall 110 of the side panel 108*a* faces the inward surface 112 of the lateral wall 110 of the side panel 108*b*. The lateral wall 110 of the side panel 108*a* extends downward 68 from the baseplate 102. The side panel 108*a* is coupled to the baseplate 102. For instance, the side panel 108*a* can be contiguous with the baseplate 102, such as when the side panel 108*a* and the baseplate 102 are formed from a single piece of sheet metal 114. The side panel 108*a* structurally supports the cabinet 12 and thus the vacuum-insulated structure 32 of the cabinet 12. To help provide such structural support, the side panel 108*a* can include a C-channel section 116 (see FIG. 15) that extends vertically upward 86 from a bottom 118 to a top 120 of the side panel 108*a*. The C-channel section 116 can be formed from the single piece of sheet metal 114 from which lateral wall 110 of the side panel 108*a* and the baseplate 102 are formed. The C-channel section 116 helps the side panel 108*a* bear the weight of the cabinet 12. The C-channel section 116 can provide a rear surface 122 of the side panel 108*a*.

The structural support 100 further includes a cross-member 124. The cross-member 124 is disposed beneath the baseplate 102. The cross-member 124 can touch the bottom surface 106 of the baseplate 102. The cross-member 124 extends laterally between the side panels 108*a*, 108*b*, such as between the C-channel sections 116 of the side panels 108*a*, 108*b*. The cross-member 124 can be disposed to be flush with the rear surfaces 122 of the side panel 108*a*, 108*b*. The cross-member 124 is attached to the side panels 108*a*, 108*b*. For example, a first end 126 of the cross-member 124 can be attached to the C-channel section 116 of the side panel 108*a* and a second end 128 of the cross-member 124 can be attached to the C-channel section 116 of the side panel 108*b*. The cross-member 124 can be a tube with a rectangular cross-section and can be made of metal.

The structural support 100 can further include leg supports 126. Each of the leg supports 126 is welded to the inward surface 112 of one of the side panels 108*a*, 108*b* and the bottom surface 106 of the baseplate 102. In the illustrated embodiment, three leg supports 126 are welded to the lateral wall 110 of the side panel 108*a* and three other leg supports 126 are welded to the lateral wall 110 of the side panel 108*b*. Each of the leg supports 126 includes a forward wall 128, a lateral wall 130, and a rear wall 132. The forward wall 128 opposes the rear wall 132. The lateral wall 130 extends between the forward wall 128 and the rear wall 132. Each of the leg supports 126 further includes a top 134 (see FIG. 13) and a bottom 136. The forward wall 128, the lateral wall 130, and the rear wall 132 all extend from the top 134 to the bottom 136. The top 134 is welded (see welds 138) to the bottom surface 106 of the baseplate 102. The forward wall 128 and the rear wall 132 are welded to the inward surface 112 of the lateral wall 110 of the side panels 108*a*, 108*b*. Each of the leg supports 126 can thus form a C-channel 140 (see FIG. 15). In embodiments, the forward wall 128 and the rear wall 132 both have a lateral width 142*a*, 142*b* and the lateral widths 142*a*, 142*b* are approximately the same. The lateral widths 142*a*, 142*b* decrease from the top 134 toward the bottom 136. The leg supports 126, like the side panels 108*a*, 108*b*, help support the weight of the cabinet 12.

Referring now to FIGS. 16-22, in other embodiments, the structural support 200 likewise includes a baseplate 202 (like numbers refer to like elements) that is horizontally oriented and welded to the bottom surface 66 of the bottom wall 38 of the outer wrapper 36. This structural support 200 likewise includes a pair of side panels 208*a*, 208*b* and leg supports 226.

The pair of side panels 208*a*, 208*b* oppose each other. The pair of side panels 208*a*, 208*b* extend downward 68 from side edges 244*a*, 244*b* of the baseplate 202. For example, the side panel 208*a* extends downward 68 from, and is disposed below, the side edge 244*a* of the baseplate 202, while the side panel 208*b* extends downward 68 from, and is disposed below, the side edge 244*b* of the baseplate 202. The side panel 208*b* is a mirror image of the side panel 208*a* in the manner addressed herein and thus only the side panel 208*a* will be particularly discussed.

The side panel 208*a* includes a lateral wall 210 with an inward surface 212. The inward surface 212 can be vertical. The side panel 208*a* further includes a top lip 246 and a bottom lip 248. The top lip 246 extends inward (e.g., horizontally) from the lateral wall 210. The bottom lip 248 likewise extends inward (e.g., horizontally) from the lateral wall 210 but elevationally below the top lip 246.

The top lip 246 includes apertures 250 therethrough. The baseplate 202 further includes apertures 252 therethrough that are aligned with the apertures 250 through the top lips 246 of the pair of side panels 208*a*, 208*b*. For example, at the side edge 244*a*, the apertures 252*a*-252*c* through the baseplate 202 are aligned with the apertures 250*a*-250*c* through the top lip 246 of the side panel 208*a*. Fasteners 254 extend through the apertures 250 through the top lips 246 of the pair of side panels 208*a*, 208*b* and the apertures 252 through the baseplate 202 to fasten the baseplate 202 and the pair of side panels 208*a*, 208*b* together. For example, the fastener 254*a* extends through the aperture 252*a* through the baseplate 202 and through the aperture 250*a* through the top lip 246 of the side panel 208*a*.

The structural support 200 can further include a carriage 256. The carriage 256 has wheels 258. The carriage 256 is disposed elevationally below the pair of side panels 208*a*, 208*b*. The carriage 256 includes a pair of horizontal sections 260*a*, 260*b*, each of which is disposed under a different one of the pair of side panels 208*a*, 208*b*. For example, the horizontal section 260*a* is disposed under the side panel 208*a*, while the horizontal section 260*b* is disposed under the side panel 208*b*. The horizontal sections 260*a*, 260*b* extend rearward 90 from a front end 262 to a rear end 264. The front end 262 and the rear end 264 are at least approximately vertically aligned with a front 266 and the rear 268 of the side panel 208*a*, 208*b* under which the horizontal section 260*a*, 260*b* is disposed.

Each of the horizontal sections 260*a*, 260*b* includes apertures 270 therethrough. The bottom lip 248 likewise includes apertures 272 therethrough. The apertures 272 are aligned with the apertures 270 through the horizontal sections 260*a*, 260*b* of the carriage 256. For example, the aperture 272*a* through the bottom lip 248 is aligned with the aperture 270*a* through the horizontal section 260*a* of the carriage 256. Fasteners 274 extend through the apertures 270, 272 that are aligned to fasten the carriage 256 and the pair of side panels 208*a*, 208*b* together. For example, the fastener 274*a* extends through the aperture 272*a* through the bottom lip 248 and the aperture 270*a* through the horizontal section 260*a* of the carriage 256. The horizontal sections 260*a*, 260*b* can be fabricated from bent sheet metal.

As mentioned, the structural support 200 further includes leg supports 226. The leg supports 226 are disposed at each of the pair of side panels 208*a*, 208*b*. For example, the leg supports 226*a*-226*c* are welded to the side panel 208*a*, while the leg supports 226*d*-226*f* are welded to the side panel 208*b*. Each of the leg supports 226 is welded to the top lip 246, the inward surface 212 of the lateral wall 210, and the bottom lip 248 of whichever of the side panels 208*a*, 208*b* at which the leg support 226 is disposed. More particularly, each of the leg supports 226 includes a forward wall 228 welded (see welds 238) to the lateral wall 210, a lateral wall 230 facing the lateral wall 210, and a rear wall 232 welded to the lateral wall 210 of whichever of the side panels 208*a*, 208*b* with which the leg support 226 is associated. Further, each of the leg supports 226 includes a top 234 welded to the top lip 246 and a bottom 236 welded to the bottom lip 248 of whichever of the side panels 208*a*, 208*b* with which the leg support 226 is associated. The forward wall 228 and the rear wall 232 each include a lateral width 242*a*, 242*b* (see FIG. 22). The lateral widths 242*a*, 242*b* decrease from the top 234 toward the bottom 236. The leg supports 226 can include any feature discussed above for the leg supports 126 of the structural support 100. The leg supports 226 at least partially bear a weight of the cabinet 12 and thus of the vacuum-insulated structure 32.

The baseplate 202 and one or more of the pair of side panels 208*a*, 208*b* can at least partially bound to the machine room 80 within the structural support 200. For example, the baseplate 202 can define a ceiling 89 of the machine room 80. The side panel 208*a* can define a side wall 90 of the machine room 80.

As with the structural support 200, this structural support 200 can likewise include a cross-member 224. The cross-member 224 is attached to both the pair of side panels 208*a*, 208*b*. The cross-member 224 is disposed rearward 90 of the leg supports 226. The cross-member 224 can be the same as the cross-member 124, and the pair of side panels 208*a*, 208*b* can each include C-channels like the pair of side panels 108*a*, 108*b* of the other structural support 100 described above.

Referring now to FIGS. 23-30, in other embodiments, the structural support 300 likewise includes a baseplate 302 (like numbers again refer to like elements). The baseplate 302 is horizontally oriented. For example, the baseplate 302 includes a top surface 304 that faces upward 86 and is at least partially co-planar with a horizontal plane. The baseplate 302 is welded to the bottom surface 66 of the bottom wall 66 of the bottom wall 38 of outer wrapper 36. The baseplate 302 further includes a bottom surface 306. The bottom surface 308 faces downward 68, while the top surface 304 faces upward 86. The baseplate 302 can be formed from sheet metal.

The baseplate 302 includes lateral sides 376*a*, 376*b*. The lateral side 376*a* faces in the lateral direction 87. The other lateral side 376*b* faces in the lateral direction 88, which is opposite of the lateral direction 87. The baseplate 302 includes lips 380*a*, 380*b* that extend downward 68 relative to the top surface 304 of the baseplate 302. The lip 380*a* is disposed at the lateral side 376*a*, while the other lip 380*b* is disposed at the other lateral side 376*b*. Each of the lips 380*a*, 380*b* includes an inward facing surface 382 (see FIG. 30).

In addition, the baseplate 302 includes clinch studs 384. The clinch studs 384 extend downward 68 from the bottom surface 306 of the baseplate 302. The clinch studs 384 are welded to the baseplate 302. The clinch studs 384 are disposed laterally inward of the lips 380*a*, 380*b* but proximate the lips 380*a*, 380*b* (e.g., within several inches from the lips 380*a*, 380*b*). For example, the clinch studs 384*a*-384*c* are disposed near the lip 380*a*, while the clinch studs 384*d*-384*f* are disposed near the lip 380*b*. The clinch studs 384 are aligned forward 74 to rearward 90.

In addition, the baseplate 302 includes tabs 386. The tabs 386 are disposed laterally inward of and facing the lips 380*a*, 380*b* of the baseplate 302. More particularly, the tabs 386 include an outward facing surface 388 that faces the lips 380*a*, 380*b* of the baseplate 302. The tabs 386 extend downward 68 from the bottom surface 306 of the baseplate 302. For example, the tabs 386*a*, 386*b* are disposed near the lateral side 376*a* of the baseplate 302, while the tabs 386*c*, 386*d* are disposed near the other lateral side 376*b* of the baseplate 302. In embodiments, at both of the lateral sides 376*a*, 376*b* of the baseplate 302, at least one of the tabs 386 is disposed forward 74 of the clinch studs 384, and at least one of the tabs 386 is disposed rearward 90 of the clinch studs 384. For example, at the lateral side 376*a* of the baseplate 302, the tab 386*a* is disposed forward 74 of the clinch studs 384*a*-384*c*, and the tab 386*b* is disposed rearward 90 of the clinch studs 384*a*-384*c*.

The structural support 300 further includes a pair of side panels 308*a*, 308*b*. The pair of side panels 308*a*, 308*b* oppose each other. The pair of side panels 308*a*, 308*b* extend downward 68 from the baseplate 302. The side panel 308*a* is disposed at the lateral side 376*a* of the baseplate 302. The other side panel 308*b* is disposed at the other lateral side 376*b* of the baseplate 302. The side panels 308*a*, 308*b*, for purposes discussed herein, are mirror images of each other. Thus, only the side panel 308*a* is particularly discussed and any such discussion applies equally as well to the other side panel 308*b*.

The side panel 308*a* includes a top wall 390. The top wall 390 is disposed under the bottom surface 306 of baseplate 302. The top wall 390 can contact the bottom surface 306 of the baseplate 302.

The side panel 308*a* further includes an outer side wall 392. The outer side wall 392 extends downward 68 from the top wall 390 of the side panel 308*a*. The outer side wall 392 faces and can contact the lip 380*a* of the baseplate 302 that is also disposed at the lateral side 376*a* of the baseplate 302. The inward facing surface 382 of the lip 380*a* faces and can contact the outer side wall 392 of the side panel 308*a*.

The side panel 308*a* further includes an inner side wall 394. The inner side wall 394 extends downward 68 from the top wall 390 of the side panel 308*a*. The inner side wall 394 is disposed inward of the outer side wall 392. The inner side wall 394 opposes the outer side wall 392. The inner side wall 394 faces and can contact the outward facing surface 388 of the tabs 386 of the baseplate 302 that are also disposed at the lateral side 376*a* of the baseplate 302 as the side panel 308*a*. The side panel 308*a* is thus sandwiched between the lip 380*a* of the baseplate 302 and the tabs 386 of the baseplate 302 that are disposed at the same lateral side 376*a* of the baseplate 302 as the side panel 308*a*.

The side panel 308*a* can further include tabs 396. The tabs 396 extend inward from the top wall 390 of the side panel 308*a*. The tabs 396 can be flush with (e.g., coplanar) the top wall 390 of the side panel 308*a*. Each tab 396 includes an aperture 398 (see FIG. 30). Each aperture 398 receives a different one of the clinch studs 384 of the baseplate 302. A nut 400 can be applied to the clinch stud 384 to secure the side panel 308*a* and the baseplate 302 together.

Each side panel 308*a*, 308*b* further includes a forward wall 402 and a rear wall 404. The forward wall 402 is disposed forward 74 of the rear wall 404. The forward wall 402 extends laterally between the outer side wall 392 and the inner side wall 394. The rear wall 404 also extends laterally between the outer side wall 392 and the inner side wall 394. A space 406 separates the forward wall 402 from the rear wall 404, and the outer side wall 392 from the inner side wall 394. A thermally and/or noise insulative material, such as foam 408, can be disposed within the space 406.

The structural support 300 further includes fasteners 410 that fasten the pair of side panels 308*a*, 308*b* and the baseplate 302 together. The fasteners 410 extend through apertures that are aligned through the lips 380*a*, 380*b* of the baseplate 302, the outer side walls 392 of the pair of side panels 308*a*, 308*b*, the inner side walls 394 of the pair of side panels 308*a*, 308*b*, and the tabs 386 of the baseplate 302 to fasten the pair of side panels 308*a*, 308*b* to the baseplate 302. For example, at the lateral side 376*a* of the baseplate 302, the lip 380*a* of the baseplate 302, the outer side wall 392 of the side panel 308*a*, the inner side wall 394 of the side panel 308*a*, and the tab of the baseplate 302 all include apertures that are aligned, and the fastener 410 extends through the apertures.

As with the other structural supports 100, 200, the pair of side panels 308*a*, 308*b* of the structural support 300 at least partially bears a weight of the cabinet 12 and thus the vacuum-insulated structure 32. In addition, the structural support 300 further includes a cross-member 324. The cross-member 324 is disposed below a rear 412 of the baseplate 302. The cross-member 324 extends in the lateral direction 87 to a first end 426 and additionally in the lateral direction 88 to a second end 428. The first end 426 is attached to the side panel 308*a*, such as with a fastener 430 that extends through the outer side wall 392, the space 406, and the inner side wall 394 of the side panel 308*a* and into the cross-member 324. The second end 428 is attached to the other side panel 308*a*, such as with another fastener 432 that extends through the outer side wall 392, the space 406, and the inner side wall 394 of the side panel 308*b*. The cross-member 324 again can be a tubular component with a rectangular cross-section.

Further, the structural support 300 can further include wheel assemblies 434. The wheel assemblies 434 are attached to the side panels 308*a*, 308*b*. For example, the wheel assembly 434*a* is attached to the side panel 308*a*, while another wheel assembly 434*b* is attached to the other side panel 308*b*. At least a portion of the wheel assembly 434*a* is disposed laterally inward of the outer side wall 392 of the side panel 308*a*.

Still further, the baseplate 302 and at least one of the pair of side panels 308*a* at least partially define a machine room 80 of the refrigerator 10. For example, the bottom surface 306 of the baseplate 302 can define the ceiling 89 of the machine room 80, and the inner side wall 394 of the side panel 308*a* can laterally bound the machine room 80.

The structural supports 100, 200, 300 address the problem described in the Background, because the structural supports 100, 200, 300 support the weight of the cabinet 12 and thus the vacuum-insulated structure 32 without the use of fasteners that extend through the outer wrapper 36 of the vacuum-insulated structure 32. Rather, the structural supports 100, 200, 300 all include a baseplate 102, 202, 302 that is welded to the bottom wall 38 of the outer wrapper 36 of the vacuum-insulated structure 32. The structural supports 100, 200, 300 all include side panels 108*a*, 108*b*, 208*a*, 208*b*, 308*a*, 308*b*, and in some embodiments, leg supports 126, 226, that support the weight of the vacuum-insulated structure 32. The baseplate 102, 202, 302 and the 108*a*, 108*b*, 208*a*, 208*b*, 308*a*, 308*b* further define the machine room 80, providing additional benefit.

According to a first aspect of the present disclosure, a refrigerator comprises: (a) a vacuum-insulated structure comprising (i) an inner liner defining a refrigeration compartment or a freezer compartment, and (ii) an outer wrapper at least partially enveloping the inner liner, the outer wrapper comprising a bottom wall disposed beneath the inner liner, the bottom wall presenting a bottom surface that faces downward; (b) a baseplate that is horizontally oriented and welded to the bottom surface of the bottom wall; (c) side panels coupled to the baseplate, extending downward from the baseplate, and structurally supporting the vacuum-insulated structure; and (d) a cross-member attached to the side panels.

According to a second aspect of the present disclosure, the refrigerator of the first aspect is presented, wherein (a) the side panels are contiguous with the baseplate, and (b) a single piece of sheet metal comprises the side panels and the baseplate.

According to a third aspect of the present disclosure, the refrigerator of any one of the first through second aspects further comprises leg supports welded to the side panels and the baseplate, the leg supports extending downward from the baseplate and inward from the side panels.

According to a fourth aspect of the present disclosure, the refrigerator of the third aspect is presented, wherein (i) the side panels comprise a lateral wall presenting an inward surface, (ii) the baseplate presents a bottom surface, and (iii) the leg supports are welded to the inward surface of the lateral wall of the side panels and the bottom surface of the baseplate.

According to a fifth aspect of the present disclosure, a refrigerator comprises: (a) a vacuum-insulated structure comprising (i) an inner liner defining a refrigeration compartment or a freezer compartment and (ii) an outer wrapper at least partially enveloping the inner liner, the outer wrapper comprising a bottom wall disposed below the inner liner, the bottom wall presenting a bottom surface that faces downward; (b) a baseplate that is horizontally oriented and welded to the bottom surface of the bottom wall; (c) a pair of side panels that oppose each other extending downward from side edges of the baseplate, each of pair of side panels comprising (i) a lateral wall with an inward surface, (ii) a top lip extending inward from the lateral wall, and (iii) a bottom lip extending inward from the lateral wall elevationally below the top lip; and (d) at each of the pair of side panels, leg supports welded to (i) the top lip of the side panel, (ii) the inward surface of the lateral wall of the side panel, and (iii) the bottom lip of the side panel; wherein, the leg supports at least partially bear a weight of the vacuum-insulated structure.

According to a sixth aspect of the present disclosure, the refrigerator of the fifth aspect is presented, wherein (i) the top lip of each of the pair of side panels includes apertures therethrough, (ii) the baseplate comprises lateral edges and apertures therethrough that are aligned with the apertures through the top lips of the pair of side panels, and (iii) fasteners extending through the apertures through the top lip of the pair of side panels and the apertures through the baseplate to fasten the baseplate and the pair of side panels together.

According to a seventh aspect of the present disclosure, the refrigerator of any one of the fifth through sixth aspects further comprising: a carriage with wheels disposed elevationally below the pair of side panels, the carriage comprising a pair of horizontal sections, each of which is disposed under a different one of the pair of side panels and each of which comprising apertures therethrough, wherein (i) the bottom lip of each of the pair of side panels comprises apertures therethrough that are aligned with the apertures through the pair of horizontal sections of the carriage, and (ii) the refrigerator further comprises fasteners extending through the apertures through the horizontal sections of the carriage and the apertures through the bottom lip of the pair of side panels to fasten the pair of side panels to the carriage.

According to an eighth aspect of the present disclosure, the refrigerator of any one of the fifth through seventh aspects is presented, wherein (i) each of the leg supports comprises a forward wall welded to the lateral wall of the side panel, a lateral wall facing the lateral wall of the side panel, a rear wall welded to the lateral wall of the side panel, a top welded to the top lip of the side panel, and a bottom welded to the bottom lip of the side panel with which the leg support is associated, and (ii) the forward wall and the rear wall each comprise a lateral width, which decreases from the top toward the bottom.

According to a ninth aspect of the present disclosure, the refrigerator of any one of the fifth through eighth aspects is presented, wherein the baseplate defines a ceiling of a machine room of the refrigerator.

According to a tenth aspect of the present disclosure, the refrigerator of ninth aspect is presented, wherein one or more of a compressor or a condenser is disposed within the machine room.

According to an eleventh aspect of the present disclosure, the refrigerator of any one of the fifth through tenth aspects is presented, wherein a cross-member is attached to both of the pair of side panels, the cross-member disposed rearward of the leg supports.

According to a twelfth aspect of the present disclosure, a refrigerator comprises: (a) a vacuum-insulated structure comprising (i) an inner liner defining a refrigeration compartment or a freezer compartment, and (ii) an outer wrapper at least partially enveloping the inner liner, the outer wrapper comprising a bottom wall disposed beneath the inner liner, the bottom wall presenting a bottom surface that faces downward; (b) a baseplate that is horizontally oriented and welded to the bottom surface of the bottom wall of the outer wrapper, the baseplate comprising (i) lips that extend downward relative to a top surface of the baseplate, one of the lips disposed at each of two lateral sides of the baseplate, (ii) clinch studs disposed laterally inward of the lips and proximate the lips, the clinch studs extending downward from a bottom surface of the baseplate, and (iii) tabs disposed laterally inward of and facing the lips, the tabs extending downward from the bottom surface of the baseplate; (c) a pair of side panels that oppose each other extending downward from the baseplate, each of pair of side panels comprising (i) a top wall disposed under the baseplate at a side of the baseplate, (ii) an outer side wall extending downward from the top wall and facing the lip of the baseplate also disposed at the side of the baseplate, and (iii) an inner side wall extending downward from the top wall inward of the outer side wall and facing the tabs of the baseplate also disposed at the side of the baseplate, such that the side panel is sandwiched between the lip of the baseplate disposed at the side of the baseplate and the tabs of the baseplate, and (d) fasteners extending through apertures that are aligned through the lip of the baseplate, the outer side walls of the pair of side panels, the inner side walls of the pair of side panels, and the tabs of the baseplate to fasten the pair of side panels to the baseplate, wherein, the pair of side panels at least partially bear a weight of the vacuum-insulated structure.

According to a thirteenth aspect of the present disclosure, the refrigerator of the twelfth aspect is presented, wherein at both of sides of the baseplate, at least one of the tabs is disposed forward of the clinch studs, and at least one of the tabs is disposed rearward of the clinch studs.

According to a fourteenth aspect of the present disclosure, the refrigerator of any one of the twelfth through thirteenth aspects is presented, wherein the lip of the baseplate disposed at the side of the baseplate comprises an inward facing surface, and the inward facing surface contacts the outer side wall of the side panel also disposed at the side.

According to a fifteenth aspect of the present disclosure, the refrigerator of any one of the twelfth through fourteenth aspects is presented, wherein each of the tabs of the baseplate at the same side of the baseplate as the side panel comprises an outward facing surface that contacts the inner side wall of the side panel.

According to a sixteenth aspect of the present disclosure, the refrigerator of any one of the twelfth through fifteenth aspects is presented, wherein each of the pair of side panels further comprises tabs extending inward from and flush with the top wall, each tab comprising an aperture receiving a different one of the clinch studs of the baseplate.

According to a seventeenth aspect of the present disclosure, the refrigerator of any one of the twelfth through sixteenth aspects is presented, wherein (a) each of the pair of side panels further comprises (i) a forward wall extending laterally between the outer side wall and the inner side wall and (ii) a rear wall disposed rearward of the forward wall and extending laterally between the outer side wall and the inner side wall, and (b) a space separates the forward wall from the rear wall and the outer side wall from the inner side wall.

According to an eighteenth aspect of the present disclosure, the refrigerator of any one of the twelfth through seventeenth aspects further comprises a cross-member that is fastened to both of the pair of side panels.

According to a nineteenth aspect of the present disclosure, the refrigerator of any one of the twelfth through eighteenth aspects further comprises wheel assemblies, each of which is attached to a different one of the pair of side panels.

According to twentieth aspect of the present disclosure, the refrigerator of any one of the twelfth through nineteenth aspects is presented, wherein the baseplate and at least one of the pair of side panels at least partially define a machine room of the refrigerator.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A refrigerator comprising:

a vacuum-insulated structure comprising (i) an inner liner defining a refrigeration compartment or a freezer compartment, and (ii) an outer wrapper at least partially enveloping the inner liner, the outer wrapper comprising a bottom wall disposed beneath the inner liner, the bottom wall presenting a bottom surface that faces downward;

a baseplate that is horizontally oriented and welded to the bottom surface of the bottom wall of the outer wrapper, the baseplate comprising (i) lips that extend downward relative to a top surface of the baseplate, one of the lips disposed at each of two lateral sides of the baseplate, (ii) clinch studs disposed laterally inward of the lips and proximate the lips, the clinch studs extending downward from a bottom surface of the baseplate, and (iii) tabs disposed laterally inward of and facing the lips, the tabs extending downward from the bottom surface of the baseplate;

a pair of side panels that oppose each other extending downward from the baseplate, each of the pair of side panels disposed at a different one of the two lateral sides of the baseplate and each of the pair of side panels comprising (i) a top wall disposed under the baseplate at the lateral side of the baseplate, (ii) an outer side wall extending downward from the top wall and facing the lip of the baseplate also disposed at the lateral side of the baseplate, and (iii) an inner side wall extending downward from the top wall inward of the outer side wall and facing the tabs of the baseplate also disposed at the lateral side of the baseplate, such that the side panel is sandwiched between the lip of the baseplate disposed at the lateral side of the baseplate and the tabs of the baseplate, and fasteners extending through apertures that are aligned through the lip of the baseplate, the outer side walls of the pair of side panels, the inner side walls of the pair of side panels, and the tabs of the baseplate to fasten the pair of side panels to the baseplate, wherein, the pair of side panels at least partially bear a weight of the vacuum-insulated structure.

2. The refrigerator of claim 1, wherein at both of the two lateral sides of the baseplate, at least one of the tabs is disposed forward of the clinch studs, and at least one of the tabs is disposed rearward of the clinch studs.

3. The refrigerator of claim 1, wherein the lip of the baseplate disposed at the lateral side of the baseplate comprises an inward facing surface, and the inward facing surface contacts the outer side wall of the side panel also disposed at the lateral side.

4. The refrigerator of claim 1, wherein each of the tabs of the baseplate at the same lateral side of the baseplate as the side panel comprises an outward facing surface that contacts the inner side wall of the side panel.

5. The refrigerator of claim 1, wherein each of the pair of side panels further comprises side panel tabs extending inward from and flush with the top wall, each side panel tab comprising an aperture receiving a different one of the clinch studs of the baseplate.

6. The refrigerator of claim 1, wherein each of the pair of side panels further comprises (i) a forward wall extending laterally between the outer side wall and the inner side wall and (ii) a rear wall disposed rearward of the forward wall and extending laterally between the outer side wall and the inner side wall, and a space separates the forward wall from the rear wall and the outer side wall from the inner side wall.

7. The refrigerator of claim 1 further comprising:

a cross-member that is fastened to both of the pair of side panels.

8. The refrigerator of claim 1 further comprising:

wheel assemblies, at least one of which is attached to each of the pair of side panels.

9. The refrigerator of claim 1, wherein the baseplate and at least one of the pair of side panels at least partially define a machine room of the refrigerator.

* * * * *